US011292655B1

(12) United States Patent
Fisher et al.

(10) Patent No.: US 11,292,655 B1
(45) Date of Patent: Apr. 5, 2022

(54) THERMALLY EFFICIENT FOOD CONTAINER

(71) Applicant: SMITTEN VENTURES, INC., San Francisco, CA (US)

(72) Inventors: Robyn Sue Fisher, San Francisco, CA (US); Tom Dair, Lafayette, CA (US); Christina Tapp, Walnut Creek, CA (US); Whitfield Janes Fowler, San Francisco, CA (US)

(73) Assignee: SMITTEN VENTURES, INC., San Francisco, CA (US)

( * ) Notice: Subject to any disclaimer, the term of this patent is extended or adjusted under 35 U.S.C. 154(b) by 61 days.

(21) Appl. No.: 16/532,226

(22) Filed: Aug. 5, 2019

Related U.S. Application Data

(60) Provisional application No. 62/714,574, filed on Aug. 3, 2018.

(51) Int. Cl.

| | |
|---|---|
| ***B65D 81/36*** | (2006.01) |
| ***B65D 81/38*** | (2006.01) |
| ***B65D 43/16*** | (2006.01) |
| ***B65D 51/18*** | (2006.01) |
| ***B65D 55/02*** | (2006.01) |
| ***B65D 85/78*** | (2006.01) |
| ***B65D 1/26*** | (2006.01) |

(52) U.S. Cl.
CPC ..... *B65D 81/3818* (2013.01); *B65D 1/26* (2013.01); *B65D 43/162* (2013.01); *B65D 51/18* (2013.01); *B65D 55/02* (2013.01); *B65D 85/78* (2013.01); *B65D 2251/0021* (2013.01); *B65D 2251/0081* (2013.01)

(58) Field of Classification Search
CPC .. B65D 81/3818; B65D 85/78; B65D 42/162; B65D 1/26; B65D 55/02; B65D 51/18; B65D 2251/0021; B65D 2251/0081; B65D 21/0233
USPC ..... 206/520; 220/4.21
See application file for complete search history.

(56) References Cited

U.S. PATENT DOCUMENTS

| | | | | |
|---|---|---|---|---|
| 1,807,476 | A * | 5/1931 | Ginsberg | B65D 81/3818 220/592.27 |
| 3,739,939 | A * | 6/1973 | Koenig | B65D 21/0233 206/518 |
| 3,795,265 | A * | 3/1974 | Schurman | B65D 43/162 206/521 |
| 4,363,404 | A | 12/1982 | Westphal | |
| 4,535,889 | A | 8/1985 | Terauds | |

(Continued)

*Primary Examiner* — Stephen J Castellano
(74) *Attorney, Agent, or Firm* — Knobbe, Martens, Olson & Bear LLP

(57) ABSTRACT

A thermally efficient container system having a lid and a base that has a chamber to include a frozen product, or a hot product. The container system includes an outer container including an outer tub and an outer lid. The outer lid can be coupled to the outer tub via one or more hinges. The container system also includes an inner container including an inner tub configured to fit into the outer tub and form a first cavity between at least a portion of the inner tub and the outer tub, and an inner lid configured to fit within at least a portion of the outer lid and adjacent to a proximal surface of the outer lid forming an enclosed second cavity between the inner lid and the outer lid. The container system can include one or more locking assemblies that are configured to secure the lid to the base.

15 Claims, 21 Drawing Sheets

(56) References Cited

U.S. PATENT DOCUMENTS

| | | | | | |
|---|---|---|---|---|---|
| 5,266,763 | A * | 11/1993 | Colombo | B65D 25/18 | 219/734 |
| 5,628,533 | A * | 5/1997 | Hill | B65D 50/046 | 292/80 |
| 5,678,725 | A * | 10/1997 | Yamada | A47J 41/0077 | 220/592.21 |
| 6,070,752 | A * | 6/2000 | Nava | B65D 43/0212 | 206/217 |
| 8,371,468 | B2 * | 2/2013 | Sellari | B65D 43/162 | 220/315 |
| 9,260,228 | B2 | 2/2016 | Buck | | |
| 2004/0118838 | A1 * | 6/2004 | Park | A47J 36/027 | 219/725 |
| 2007/0267420 | A1 * | 11/2007 | Brockel | A45C 11/20 | 220/592.2 |

* cited by examiner

THERMALLY EFFICIENT FOOD CONTAINER

RELATED APPLICATIONS

This application claims the benefit of U.S. Provisional Application No. 62/714,574, filed Aug. 3, 2018, and titled "Thermally Efficient Food Container," which is incorporated by reference herein in its entirety.

TECHNICAL FIELD

This disclosure relates to thermally efficient containers, and in particular to thermally efficient containers which can be used to contain, protect, and thermally isolate food contained therein, such as frozen confections.

BACKGROUND

A background is provided for introductory purposes and to aid the reader in understanding the detailed description. The background should not be taken as an admission of any prior art to the claims.

A wide variety of containers can be used to store frozen confections. In some embodiments, a pint-sized tapered cylinder of plastic-lined paper can be used to store frozen confections. Such containers have a rolled edge and a lid made from similar materials that presses onto the top mouth of the container to seal the frozen confection off from the elements.

Some embodiments of containers serve to keep food safe from contamination, but when placed in warm environments, fail to prevent rapid melting of the frozen confection. Reusable containers made from plastic and metal can be used to keep food cold or hot, but these may not be suitable for retail environments or single-use packaging applications. Styrofoam containers are thermally efficient, but have well-documented environmental impacts and have fallen out of favor in the current market environment.

SUMMARY

Various embodiments of the container system can include, one, all, or any combination of features of this paragraph. One innovations is a thermally efficient container system that includes an outer container including an outer tub having a first base and a first sidewall, the first sidewall extending from the first base to a rim that surrounds a top opening of the outer tub, the first base and first sidewall together defining a first chamber at least partially surrounded by the outer tub, the outer tub having a proximal surface adjacent to the first chamber and a distal surface opposite the proximal surface, the lid configured to fit over the top opening of the outer tub, the outer lid having a proximal surface configured to face towards the first chamber of the outer tub when the outer lid is closed over the top opening of the outer tub, and a distal surface opposite the proximal surface. The thermally efficient container also includes an inner container including an inner tub having a second base and a second sidewall that extends from the second base to a rim that surrounds a top opening of the inner tub, the second base and second sidewall together defining a second chamber at least partially surrounded by the inner tub, the inner tub having a proximal surface adjacent to the second chamber and a distal surface opposite the proximal surface, the inner tub configured to fit in the first chamber of the outer tub at a position to form a first cavity between the proximal surface of the outer tub and the distal surface of the inner tub, the inner tub and the outer tub configured to contact each other along at least a portion of the rim of the outer tub and a portion of the rim of the inner tub when the inner tub is positioned in the first chamber, and an inner lid configured to fit within at least a portion of the outer lid and adjacent to the proximal surface of the outer lid forming an enclosed second cavity between the inner lid and the outer lid, the inner lid having a proximal surface configured to face towards the second chamber of the inner tub when the inner lid is positioned in the outer lid and the outer lid is closed over the top opening of the outer tub, the inner lid further having a distal surface opposite the proximal surface facing the outer lid when the inner lid is positioned in the outer lid.

Various embodiments of such containers can include additional features, or fewer features. For example, the thermally efficient container system can further include at least one hinge coupled to an edge of the outer lid and the rim of the outer tub, the at least one hinge comprising the same material as the outer tub and the outer lid. The proximal surface of the inner lid can include a partially raised portion having an ornamental design, the partially raised portion surface configured to extend partially into the second chamber when the inner lid is in a closed position over the second chamber such that the partially raised inner portion of the proximal surface of the inner lid can contact a top surface of a product filling the inner tub. The size of a gap of the first cavity between at least a portion of proximal wall of the outer container and the distal wall of the inner container is between about 3 mm and about 7 mm, and at least a portion of a gap of the second cavity between the distal surface of the inner lid and the proximal surface of the inner lid is between about 3 mm and about 7 mm. The first cavity can be formed between at least 90% of the area of the proximal surface of the outer tub and the distal surface of the inner tub. The first base of the outer container can include at least one support extending towards the first chamber, the at least one support configured to contact the distal surface of the inner container. The at least one support can be configured to contact less than 10% of the distal surface of the inner container. The at least one support can be configured to contact less than 5% of the distal surface of the inner container. The at least one support can be configured to contact less than 2% of the distal surface of the inner container. The at least one support can include a raised portion of the base of the outer container, the raised portion extending towards the first chamber. The at least one support can include two or more supports, and the two or more supports can be different in size (e.g., the width of the support and/or the area of the contact between the support and the inner tub may be different. The base of the inner container can include at least one recess, the at least one recess located on the second base at a location corresponding to the location of the at least one support of the outer container, and the at least one recess being configured to receive at least a portion of a corresponding at least one support. The container can further include a locking assembly. The locking assembly can include a first structure coupled to an edge of the outer lid, and a second structure of the locking assembly coupled to and edge of the outer tub. The first structure can be flat and t-shaped, and the second structure can include at least one notch, the locking assembly configured to have a portion of the first structure extend through the at least one notch when the locking mechanism is in a locked position. In some embodiments, the container system can also include at least one hinge coupled to a side of the outer lid and the outer tub, on an edge of the outer lid and an edge of the outer tub, and the locking assembly can include a first structure coupled to the edge of the outer lid and positioned on a side of the outer lid opposite the hinge, and a second structure coupled to the edge of the outer tub and positioned on a side of the outer tub opposite the hinge.

Another innovation includes a thermally efficient container system having a plurality of outer containers, each an outer container including an outer tub having a first base and a first sidewall, the first sidewall extending from the first base to a rim that surrounds a top opening of the outer tub, and an outer lid coupled to the outer tub via a hinge, the lid configured to fit over the top opening of the outer tub and move, via the hinge, from an open position not covering the top opening to a closed position covering the top opening, and a plurality of inner containers, each an inner container including an inner tub having a second base and a second sidewall that extends from the second base to a rim that surrounds a top opening of the inner tub, the inner tub configured to fit in the outer tub at a position to form a first cavity between a proximal surface of the outer tub and a distal surface of the inner tub, the inner tub and the outer tub configured to contact each other along at least a portion of the rim of the outer tub and a portion of the rim of the inner tub when the inner tub is positioned in the outer tub, and an inner lid configured to fit in at least a portion of the outer lid and adjacent to a proximal surface of the outer lid forming an enclosed second cavity between a distal surface of the inner lid and the proximal surface of the outer lid, the inner lid wherein the proximal surface of the inner lid includes a partially raised portion having an ornamental design, the partially raised portion surface configured to extend away towards a chamber of the inner tub when the inner lid is in a closed position over the inner tub such that the partially raised inner portion can contact a top surface of a product filling the inner tub. The plurality of outer containers are configured to fit together in a nested fashion such that an outer tub of a first outer container of the plurality of outer containers fits into at least a portion of another adjacently disposed outer tub of a second outer container, and the outer lid of the first outer container fits into at least a portion of a lid of the second outer container. The plurality of inner containers are configured to fit together in a nested fashion such that the tub of a first inner container fits into at least a tub of a second inner container, and a lid of the first inner container fits into at least a portion of a lid of a second inner container.

BRIEF DESCRIPTION OF THE DRAWINGS

FIG. 14 also illustrates a plurality of inside containers with the inner tubs are nested together and the inner lids are nested together in a compact fashion that is advantageous for shipping and storage of the inside containers.

DETAILED DESCRIPTION

Figure 1A:
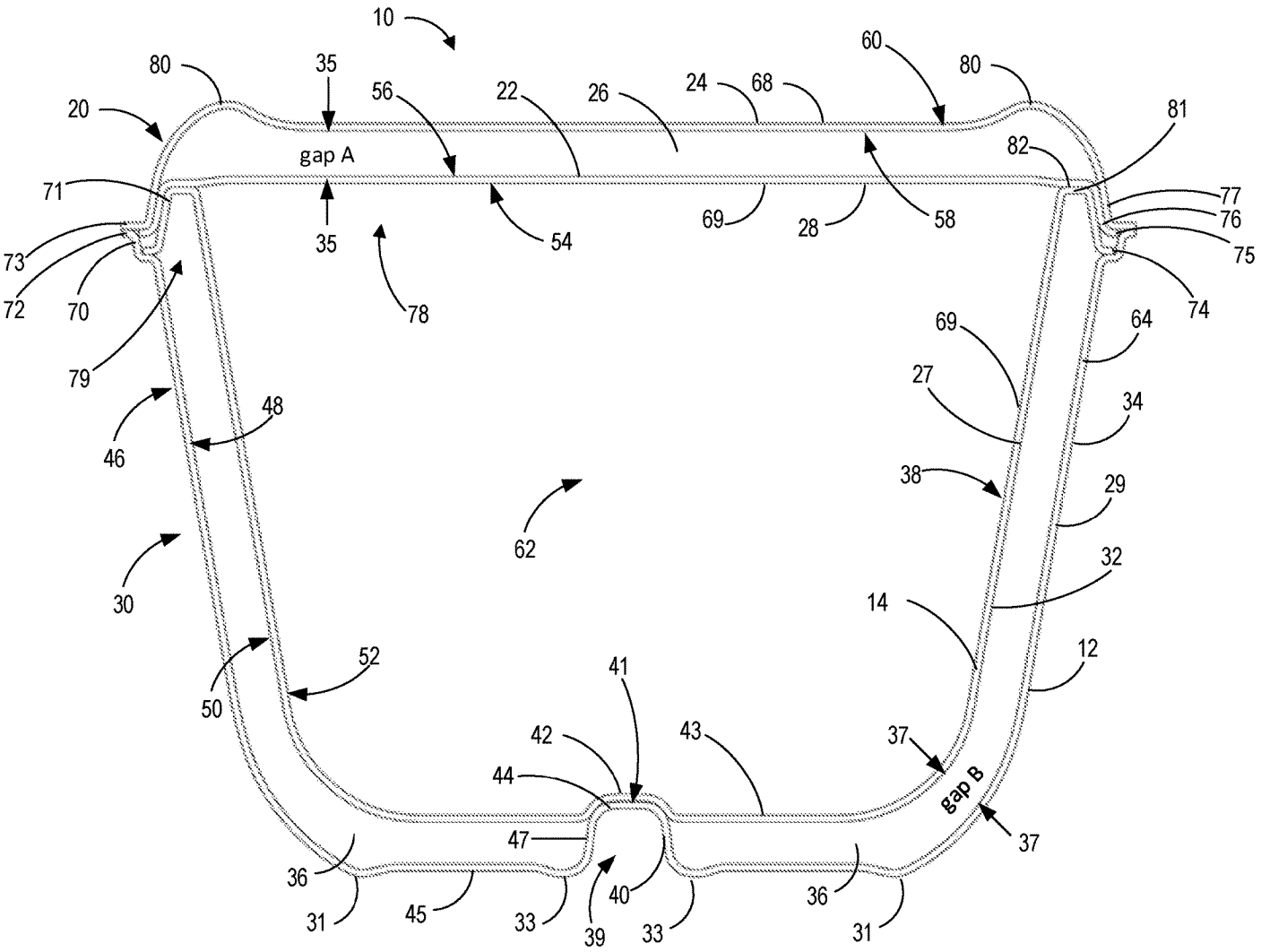
FIG. 1A is a cross section view of an example of a thermally efficient container including an inner container and an outer container.

In some embodiments, thermally efficient containers are provided, which can be used to contain, protect, and thermally insulate food or beverages. Embodiments of thermally efficient containers can be used to pack, store, and transport cold food, such as frozen confections. Examples of frozen confections include ice cream, sorbet, custard, yogurt, gelato, smoothies, and frozen blended açaí bowls and pitaya bowls. Embodiments of thermally efficient containers can also be used to store hot food or beverages, such as soups, stir-fries, rice dishes, pastas, curries, puddings, chilies, chicken, beef, fish, pork, and tofu.

In various embodiments, a thermally efficient container has one or more of the following properties which gives it advantages over currently available containers that are used to store and ship frozen goods: made from FDA food grade material, freezer safe, 100% moisture holdout (e.g., material will not absorb moisture from ice cream), double wall construction having an enclosed cavity surrounding the tub of the base container and an enclosed cavity in the lid thus providing superior thermal performance compared to a single wall container, compostable, and has structural integrity with an inner lid sealing the product. Thermal containers that include an inner and outer lid are configured such that the inner lid stays attached to the outer lid when the container is opened. Thermal containers that include an inner tub and outer tub are configured to ensure that the inner tub stays within an attached to the outer tub when product is being hand packed into the inner tub, when the product is being removed from the inner tub, and when the container is filled with product and shipped.

Other advantages of the double walled thermal containers described herein, in respect to various example embodiments, include that they will keep a frozen product contained therein sufficiently cold (e.g., at less than 18 degrees F.) three times longer than a single wall container, the containers can be nested together for shipping, they are easy to assemble in a shop selling frozen product, they are easy to fill with the frozen product, they are easy to label as the outside surface is typically drier, they can include a tamperproof locking assembly, they are stackable on a shelf or in a freezer, they can include a living hinge, and they can include a surface which embosses product disposed inside the container with an ornamental feature (for example, a trademark or logo). In some embodiments, an inner container may be bleached and outer container may be unbleached to provide color differences and other aesthetic qualities In some embodiments, the geometry of the container and lid facilitate additional functionalities. The draft on the walls of each molded component may be specified to be sufficient to facilitate release from the manufacturing tooling. The draft on the vertical walls also facilitates the nesting of components for shipping and storage, and the stacking of assembled lids, or assembled containers.

In some embodiments, such as the embodiments illustrated in the figures, the geometry of the top surface of the outer layer of the lid engages with the geometry of the bottom surface of the outer layer of the container in such a way as to provide stability when one closed container is stacked on top of another closed container.

In some embodiments, the inner layer of the lid is formed with a logo. When the container is packed with a sufficient quantity of frozen confection and then closed, this logo is pressed into the frozen confection. In other different embodiments, other words, symbols, images, artwork, and markings are pressed into the frozen confection. During use when the lid is opened, the desired shape remains in the frozen confection and is visible to the customer.

In some embodiments, embodiment of thermally efficient containers can be used in the fashion of a single-use package of ice cream. The container can be purchased from the manufacturer and can be delivered fully assembled to the location where it will be packed with frozen confection. In some embodiments, the lid and container components can be shipped separately from the manufacturer and can be assembled at the location where the frozen confection will be packed into the containers.

In use, an employee of the company selling the product packs the frozen confection into the assembled container, closes the lid, and pushes the locking tab down into the closed position. The now-full container can now be transported to a different facility, or is placed into a freezer at that location to await being sold. Once the product has been purchased, the customer may choose to open the container on site, or transport it to a different location for consumption. At a time and place of their choosing, the customer will lift the locking tab feature, open the lid of the container, scoop out the frozen confection, and hopefully enjoy.

In some embodiments, embodiment of thermally efficient containers can be used in the fashion of a single-use package of hot food such as soup. The containers can be purchased from the manufacturer and are delivered to the food preparation location in boxes containing either the outer layer or the inner layer of the container. The outer layers can be nested inside of each other so that more pieces can be shipped per unit volume as compared to pre-assembled containers. The inner layers can likewise be nested in their own boxes.

In use, an employee of the company selling the product fills soup into the assembled container, closes the lid, and pushes the locking tab down into the closed position. The now-full container is transported directly to a retail customer. Once the product arrives, the customer may choose to open the container on site, or transport it to a different location for consumption. At a time and place of their choosing, the customer will lift the locking tab feature, open the lid of the container, and hopefully enjoy the soup.

CERTAIN FEATURES ILLUSTRATED IN THE FIGURES ARE LISTED BELOW

10 container
12 outer container
14 inner container
20 lid
22 inner-most layer of the lid
24 outer-most layer of the lid
26 second cavity
27 second sidewall inner tub
28 inner surface of inner-most layer of the lid
29 first sidewall outer tub
30 base
31 outer footing
32 inner-most layer of the base
33 inner footing
34 outer-most layer of the base
35 gap A between the inner lid
36 first cavity
37 gap B between inner tub and outer tub
38 inner surface of inner-most layer of the base
39 recess of outer tub
40 support feature
41 recess of inner tub
42 raised portion of inner tub
43 inner tub (base)
44 raised portion of outer tub base
45 outer tub (base)
46 outer tub distal surface
47 wall of support feature
48 outer tub proximal surface
50 inner tub distal surface
52 inner tub proximal surface
54 inner lid proximal surface
55 raised portion of inner lid proximal surface
56 inner lid distal surface

57 lowered portion of outer lid
58 outer lid proximal surface
60 outer lid distal surface
61 first chamber
62 second chamber
64 outer tub
66 inner tub
68 outer lid
69 inner lid
70 rim outer tub
71 rim inner tub
72 edge of outer tub
73 edge outer lid
74 edge of inner tub
75 edge of inner lid
76 rim of inner lid
77 rim of outer lid
78 opening of inner tub
79 opening of outer tub
80 raised edge of outer lid
81 lid support/top portion of inner tub
82 support portion of inner lid
83 locking assembly
84 first structure of locking assembly
85 second structure of locking assembly
86 notch in second portion of locking assembly
87 product
88 hinge
89 portion of hinge coupled to lid
90 portion of hinge couple to outer tub
91 embossed ornamental design
92 inner tub separation structure FIG. 1A is a cross section view of an embodiment of a thermally efficient container 10, which may be described as including a cup-shaped lower base 30 and a lid 20, each constructed from multiple layers of material. The innermost layer 22 of the lid 20 and innermost layer 32 of the base 30 are constructed from or include a layer of food-safe material. In some embodiments, these layers 22 and 32 are constructed from or otherwise include a compostable material, such as a natural-fiber-based material. In some embodiments, the compostable material meets the ASTM D6400 testing standard or the ASTM D6868 testing standard, or another standard for composability. Exemplary materials may include, but are not limited to, natural fiber, virgin paper pulp, food-safe polymer, and polymer-laminated paper. These layers may be formed, for example, via a pulp molding process, although other suitable fabrication processes may also be used. One example is the set of processes of corrugated paper manufacturing including pressing, drying, and bonding. Another example is the set of processes of spiral-wound paper tube manufacturing, including spiral-winding. Another example is the set of processes of polymer part manufacturing including injection molding, blow molding, and vacuum forming. Another example is the set of processes associated with applying moisture-resistant barriers including laminating, spraying, coating, and curing. At least a portion of the inner surfaces 28 and 38 of the inner layers 22 and 32, respectively, may be coated with a moisture-hold-out coating, which may be applied after the molded forms have dried.

The outermost layer 34 of the base 30 and the outermost layer 24 of the lid 20 may also be formed from a compostable material, such as a natural-fiber-based material. However, in other embodiments, the outermost layers 24 and 34 of the container 10 may be formed from a different material, such as a reusable material. Exemplary materials which may be used for the outermost layers 24 and 34 include, but are not limited to, compostable natural fiber, post-consumer natural fiber, virgin polypropylene, post-consumer polymers, and stainless steel. The color and texture of the outermost layers 24 and 34 may be selected for aesthetic reasons to facilitate marketing efforts and provide enjoyable customer experiences of the product.

The geometry and wall thicknesses of the layers of the base 30 and lid 20 are specified to provide sufficient strength to retain their shape during use, including packing, storing, transporting, and serving. In addition, the innermost layer 32 and outermost layer 34 of the base 30 are dimensioned to define one or more cavities 36 therebetween, which may be filled with air. The geometry and thickness of cavity 36 are specified to create effective thermal insulation. The outermost layer 34 thus serves to define the cavity 36 which confines a volume of air, as well as to provide structural rigidity and facilitate labeling and handling. In the embodiment illustrated in FIG. 1A, the geometry of the outermost layer 34 incorporates a support feature 40 that contacts the inner layer 32 and adds rigidity to the bottom surface of the inner layer 32. This increase in rigidity provided by the support features 40 helps prevent deformation of the inner container layer 32 during use, such as for example during packing, transportation, or consumption. In some embodiments, additional support features may be included to maintain the integrity of the cavity 36, such as corrugation, ribs, or other structural supports within the cavity 36.

The lid 20 similarly includes a cavity 26 defined between the inner layer 22 and the outer layer 24, which provides a similar double-walled configuration. The double-walled construction of the lid 20 serves the same insulating function as the construction of the base 30. Likewise, the materials and manufacturing methods of the inner and outer layers 22 and 24 of the lid 20 may be the same as their respective counterparts in the base 30.

The multiple layer construction of such an embodiment reduces the rates of thermal energy transfer between the food and the surrounding environment via conduction, convection, and radiation. Such embodiments increase the amount of time food will remain in its preferred temperature range as compared to a standard single-walled container made from similar materials. Frozen confections will remain frozen longer, and hot foods will remain hot longer.

In some embodiments, an additional layer that is opaque to infrared and visible light is included to further reduce energy transfer via radiation. In some embodiments this layer is also reflective. In different embodiments, this layer includes or is constructed from one or more of a range of suitable materials including a spray-on coating of paint or ink, a layer of foam, a thin layer of metalized polymer, reflective foil, and a multilayer blown extruded film. In some embodiments, this layer is wrapped around the base 30. In some embodiments, this layer is wrapped around the lid 20. In some embodiments this layer serves an additional function as the product labeling. In some embodiments this layer is positioned in between the outermost layer of the base 34 and the cavity 36. In some embodiments this layer is positioned in between the outermost layer of the lid 24 and the lid cavity 26.

In some embodiments, each layer of the container is a component that must be assembled together before the container is fully functional. In this embodiment, the outer layer components may be nested for storage, the inner layer components may be nested for storage, and the fully-assembled containers may be stacked. Thus, embodiments of a thermally efficient container system (container) 10 may also be described as including an outer container 12 (see also, e.g., FIG. 11) including an outer tub 64 and an outer lid 68, and an inner container 14 (see also, e.g., FIG. 12) including an inner tub 66 and an inner lid 69.

The outer tub 66 of the outer container 12 can include a first base 45 and a first sidewall 29, the first sidewall 29 extending around the outer tub and from the first base 45 to a rim 70 that surrounds a top opening 79 of the outer tub 66. The first base 45 and first sidewall 29 together define a first chamber 61 (see e.g., FIG. 16) at least partially surrounded by the outer tub 66, the outer tub 66 having a proximal surface 48 adjacent to the first chamber 61 and a distal surface 46 opposite the proximal surface 48.

The outer container 12 also includes an outer lid 68. In some embodiments, the outer lid 68 can be coupled to the outer tub 64 via at least one hinge 88 (see e.g., FIG. 6). The outer lid 68 can be configured to fit over the top opening 79 of the outer tub 64 and move, via the hinge 88, from an open position not covering the top opening 79 to a closed position covering the top opening 79. In some embodiments, the outer container 12 does not include a hinge, the outer lid 68 having a snug friction fit onto the outer tub 64. The outside lid 68 includes a proximal surface 54 configured to face towards the first chamber 61 of the outer tub 64 when the outer lid 68 is closed over the top opening 79 of the outer tub 64. The outside lid also includes a distal surface 60 opposite the proximal surface 54.

In various embodiments, the inner container 12 can include an inner tub 66 having a second base 43 and a second sidewall 27 that extends from the second base 43 to a rim 71 that surrounds a top opening 78 of the inner tub 66. The second base 43 and the second sidewall 27 together define a second chamber 62 at least partially surrounded by the inner tub 66. The inner tub 66 includes a proximal surface 52 adjacent to the second chamber and a distal surface 50 opposite the proximal surface 52. The inner tub 66 is configured to fit in the first chamber 61 of the outer tub 64 at a position to form a first cavity 36 between the proximal surface 48 of the outer tub 64 and the distal surface 50 of the inner tub 66. The inner tub 66 and the outer tub 64 are configured to contact each other along at least a portion of the rim 70 of the outer tub 64 and a portion of the rim 76 of the inner tub 66 when the inner tub 66 is positioned in the first chamber 61.

The inner lid 69 can be configured to fit within at least a portion of the outer lid 68 such that it is adjacent to the proximal surface 58 of the outer lid 68 forming an enclosed second cavity 26 between the inner lid 69 and the outer lid 68. The inner lid 69 has a proximal surface 58 configured to face towards the second chamber 62 of the inner tub 66 when the inner lid 69 is positioned in the outer lid 68 and the outer lid is closed over the top opening of the outer tub 68. The inner lid 69 further having a distal surface 56 opposite the proximal surface 58 of the inner lid 69 facing the outer lid 68 when the inner lid 69 is positioned in the outer lid 68.

Various embodiments of a thermally efficient container can include one or more support features 40. The support features 40 provide one or more points of support between the outer tub 64 and the inner tub 66. In the embodiment illustrated in FIG. 1A, the container includes one support feature 40 that extends from the base 45 of the outer tub 64 inward such that a raised portion of the outer tub 44 contacts a portion of the inner tub 66 in a recess 41 of the inner tub 66. The support feature includes a wall 47 that extends between the outer tub 64 and the inner tub 66. The recess 41 is positioned to receive the support feature 40. In this configuration where a support feature extends into a recess of the inner tub, the inner tub 66 is supported by the support feature 40 in a vertical direction (relative to the orientation of the figure) and also in the lateral direction (relative to the orientation the figure). In this embodiment, the support feature 40 forms a recess 39 in the outer tub 64. In some embodiments, the support feature may contact the inner tub but may not extend into a recess of the inner tub. In some embodiments, the container may include more than one support feature, that is, a plurality of support features, that contact both the inner tub 66 and the outer tub 64 (or are part of one or both of the inner tub 66 and the outer tub 64). In some embodiments, the support feature can be a structure that fits between the inner tub 66 in the outer tub 64.

Still referring to the container in FIG. 1A, the outer tub 64 may include one or more footings 31, 33 such that when the outer tub is set on a flat surface the footings provide a gap between the portion of the outer tub base 45 in the flat surface. The one or more footings 31, 33 may provide thermal separation between the outer tub base 45 and a warm surface that the containers set on.

In various embodiments, the top of the lid 20 may include a raised edge 80. Having a raised edge 80 which can provide for some lateral support when containers are stacked on top of each other.

In the example illustrated in FIG. 1A, the first cavity 36 is formed between the distal surface 50 of the inner tub 66 and the proximal surface 48 of the outer tub 64. The gap B 37 between the distal surface 50 of the inner tub 66 and the proximal surface 48 of the outer tub 64 may vary throughout the cavity 36, for example, it may go to zero where a support feature 40 of the outer tub 64 contacts the inner tub 66. In an example, at least a portion of the cavity 36 has a gap B 37, between the distal surface 50 of the inner tub 66 and the proximal surface 48 of the outer tub 64, of between 2 mm and 8 mm. In another example, at least a portion of the cavity 36 has a gap B 37, between the distal surface 50 of the inner tub 66 and the proximal surface 48 of the outer tub 64, of between 3 mm and 7 mm. In another example, at least a portion of the cavity 36 has a gap B 37, between the distal surface 50 of the inner tub 66 and the proximal surface 48 of the outer tub 64, of between 4 mm and 6 mm. In another example, at least a portion of the cavity 36 has a gap B 37, between the distal surface 50 of the inner tub 66 and the proximal surface 48 of the outer tub 64, of 3 mm, or of 4 mm, or of 5 mm, or of 6 mm, or of 7 mm, or of 8 mm.

In the example illustrated in FIG. 1A, the second cavity 26 is formed between the distal surface 60 of the inner lid 69 and the proximal surface 58 of the outer lid 68. The gap A 35 between the distal surface 60 of the inner lid 69 and the proximal surface 58 of the outer lid 68 may vary throughout the cavity 35, for example, it may be a gap of 4 mm in the middle of the lid, and go to 0 mm where inner lid 69 in the outer lid 68 to contact each other. In an example, at least a portion of the cavity 35 has a gap A 35, between the distal surface 60 of the inner lid 69 and the proximal surface 58 of the outer lid 68, of between 2 mm and 8 mm. In another example, at least a portion of the cavity 36 has a gap A 35, between the distal surface 60 of the inner lid 69 and the proximal surface 58 of the outer lid 68, of between 3 mm and 7 mm. In another example, at least a portion of the cavity 36 has a gap A 35, between the distal surface 60 of the inner lid 69 and the proximal surface 58 of the outer lid 68, of between 4 mm and 6 mm. In another example, at least a portion of the cavity 36 has a gap A 35, between the distal surface 60 of the inner lid 69 and the proximal surface 58 of the outer lid 68, of 3 mm, or of 4 mm, or of 5 mm, or of 6 mm, or of 7 mm, or of 8 mm.

Figure 2:
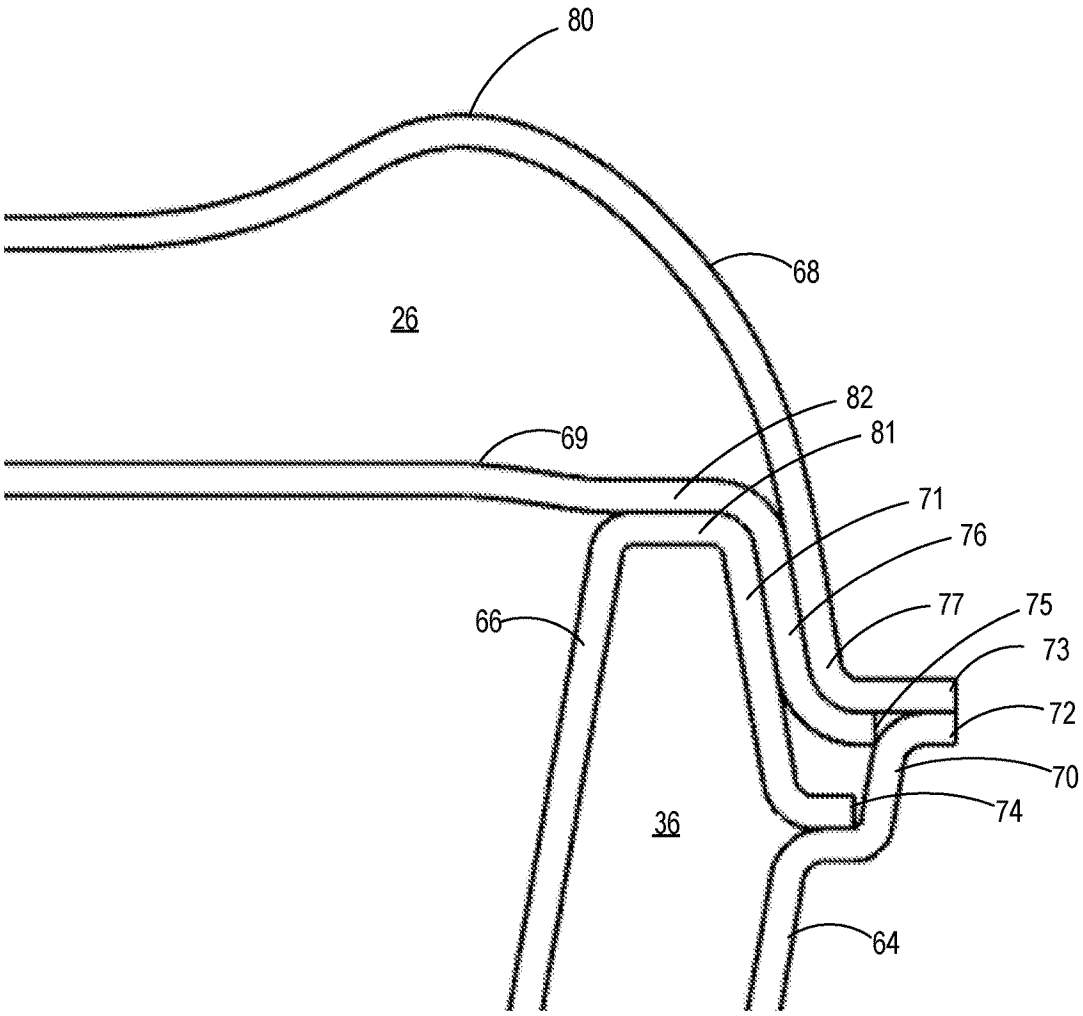
FIG. 2 is a detailed cross sectional view of the lid-to-container interface geometry of the thermally efficient container of FIG. 1A.

The example illustrated in FIG. 1A shows an embodiment a configuration of the edge 75 of the inner lid 69 and the edge 73 of the outer lid 68, and the edge 74 of the inner tub 66 and the edge 72 of the outer tub 64. The example illustrated in FIG. 1A shows a configuration of the rim 76 of the inner lid 69 and the rim 77 of the outer lid 68, and the rim 71 of the inner tub 66 and the rim 70 of the outer tub 64 for the illustrated embodiment. FIG. 2 illustrates the configuration of FIG. 1A in greater detail.

Other configurations of the rims and edges of the inner and outer lid and the inner and outer tubs are also possible. Some examples are illustrated in FIGS. 6, 7A-7D, 8A-8C, 9 and 10. All of these configurations provide enclosure of the first cavity 36 and the second cavity 26. Other configurations are also possible. These examples show various configurations of how the edges and rims of the inner and outer tubs can be aligned and can fit together to enclose the first cavity 36 such that air in the first cavity 36 insulates a product in the container 30 from the environment outside of the container 30. These examples also show various configurations of how the edges and rims of the inner and outer lids can be aligned and can fit together to enclose the second cavity 26 such that air in the second cavity 26 insulates a product in the container 30 from the environment outside of the container 30.

These example configurations are designed such that the structure of the inner tub "locks" into the outer tub, and the structure of the inner lid "locks" into the outer lid using friction and/or by pressure. For example, in the example illustrated in FIG. 2, the edge 74 of the inner tub 66 is sized to press against an inside portion of the rim 70 of the outer tub 64 to help lock the inner tub 66 into the outer tub 64. Also, in the example illustrated in FIG. 2 the rim 76 of the inner lid 69 locks into place against the rim 77 of the outer lid 68 by friction of the portion of the rims 76, 77 that are adjacent to each other.

All of these configurations also provide for a tight seal of the lid 20 on the base 30. In the example illustrated in FIG. 2, the lid 60 locks onto the base 30 by a friction fit between the rim 71 of the inner tub in the rim 76 of the inner lid, as well as the edge 75 of the inner lid 69 fitting against a portion of the rim 70 of the outer tub 64. In the figures herein, when an edge or rim of a tub or lid is shown in contact with the surface of another edge or rim of a lid or tub, it generally indicates that these components are sized to coupled together by friction and/or pressure, is one of skill in the art will appreciate.

Any of these configurations of edges of the inner and outer lids and inner and outer tubs can be used with one or more hinges coupling a portion of the lids to the tubs, and/or be used with one or more locking assemblies.

In some embodiments, the outer layer of the lid and the outer layer of the container are one component. In some such embodiments, the singular container-and-lid component can also include features that create a locking mechanism for use after the container has been packed. One specific embodiment of such a design can be seen in FIGS. 3-5. After the lid is closed, a tab 50 on the rim of the lid 20 is folded down so that it engages with a pair of tabs 52 on the rim of the base 30. After this engagement is made, the container exerts a downward force on the lid through the set of tab features 52. This force helps to keep the lid 20 closed. The singular container-and-lid component can be held together by a living hinge 60 on the side of the container opposite the tab 50 and tab features 52.

In certain of such embodiments, the container-and-lid component can have geometry that allows it to stack, and that can allow the final assemblies to be stacked after inner and outer layers have been combined. In some embodiments, the lid 20 is a separate part from the base 30. In some embodiments, the lid 20 is secured relative to the base to the base 30 by via a press-fit arrangement. In some embodiments, the lid 20 is secured to the base 30 by means of two (2) or more tab features that engage to create a downward force on the lid 20 towards the base 30.

In some embodiments, the lid 20 and the base 30 are secured together by means of a strap, cord, adhesive tape, or similar structure of various sizes and shapes, which may be adhered to or otherwise connected to or pulled taut around a portion of container 10 to hold lid 20 in place against base 30. Many different shapes or arrangements may be used.

In some embodiments, a strip of tape extends around the circumference of the rims of the lid 20 and base 30. In some embodiments the shape of the tape, strap, cord or similar structure may include one or more loops from the underside of the base 30 up and over the top of the lid 20. In some embodiments the shape is a single strip that loops from the side or underside of the base 30 over the top of the lid 20 and back around to the side or underside of the base 30. In some embodiments the shape includes one or more strips that loop from the top of the lid 20 around to the front face of the base 30 then to the underside of the base 30 and back up to the top of the lid 20 where there is a tab to facilitate opening the container. In some embodiments the lid 20 is secured to the base 30 through a combination of press-fit, living hinge, tab and adhesive features. In some embodiments the tape is compostable. In some embodiments, the tape may be removed before the container is composted.

Figure 1B:
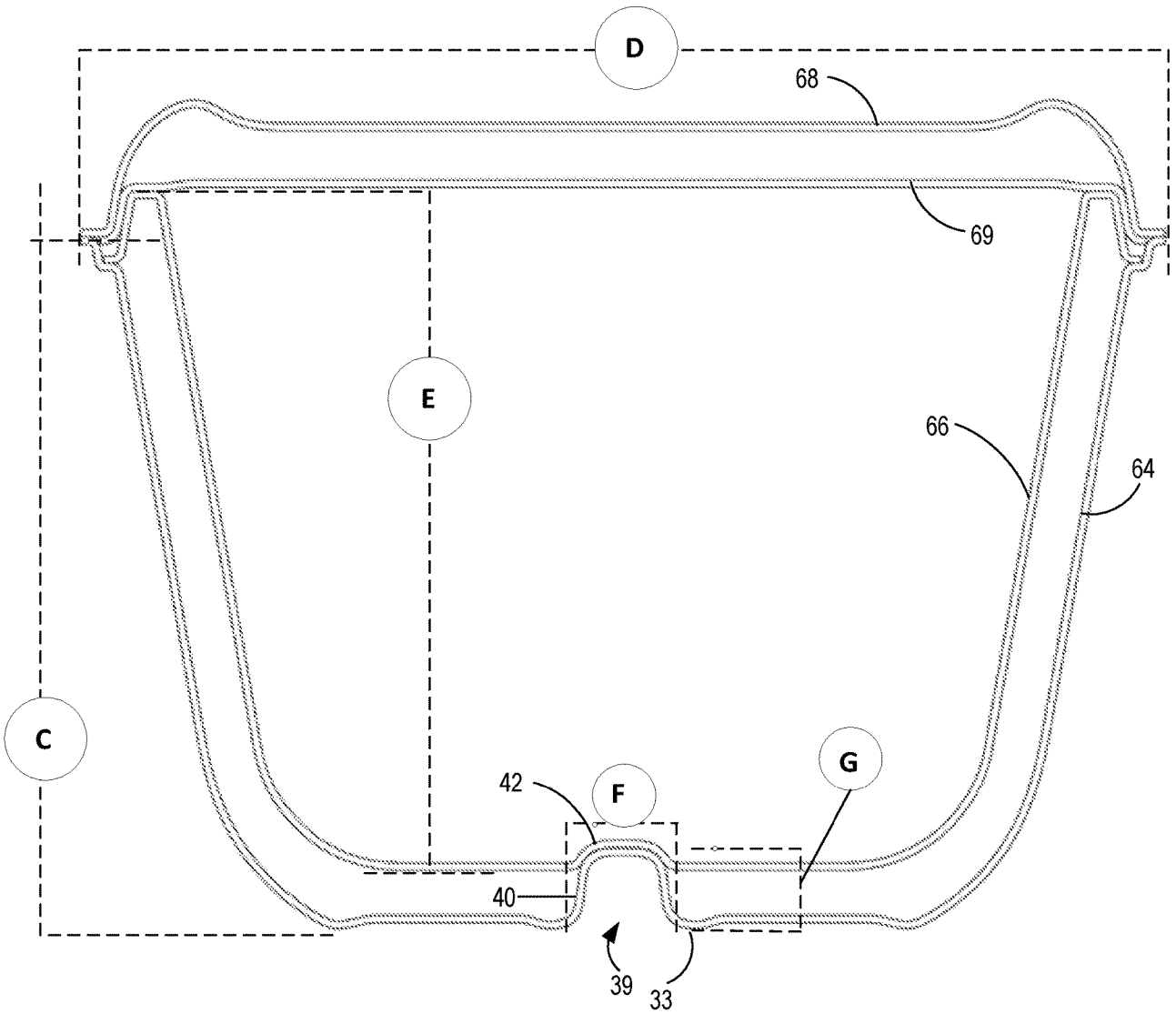
FIG. 1B is a cross section view of the example of a thermally efficient container of FIG. 1A illustrating certain dimensions.

FIG. 1B is a cross section view of the example of a thermally efficient container of FIG. 1A illustrating certain examples of dimensions for various components of the container 10. Although certain dimensions are described here which generally relate to containers that may hold, for example, a portion of a pint, a pint, or two pints of a frozen product, various embodiments of the container can have other dimensions. In this example, the height C of the outer tub 64 can be between about 50 mm and 150 mm, for example, 74 mm. In this example, the length D of the outer lid 68 and the outer tub 64 can be between about 80 mm and 200 mm, for example, 117 mm. In this example, the height E of the inner tub 66 can be between about 50 mm and 150 mm, for example, 74 mm. In this example, the width F of a portion of the support feature 40 can be between about 5 mm and 70 mm, for example, 14 mm. In this example, the height G of a portion of the support feature 40 can be between about 3 mm and 20 mm, for example, 7 mm.

In some embodiments, the geometry of the lower rim of the lid and the upper rim of the container are specified to allow for a secure mechanical connection of the lid to the container. FIG. 2 is a detailed cross sectional view of the lid-to-container interface geometry of the thermally efficient container of FIG. 1A. Such a geometry serves to protect the frozen confection from contamination after being packed. FIG. 2 illustrates in more detail an embodiment where a portion of the rim 76 of the inner lid 69 is locked into place by friction against a portion of the rim 77 of the outer lid 68, thus enclosing the second cavity 26. Also, as illustrated in FIG. 2, the edge 74 of the inner tub 66 is sized to press against an inside portion of the rim 70 of the outer tub 64 to help lock the inner tub 66 into the outer tub 64.

Figure 3:
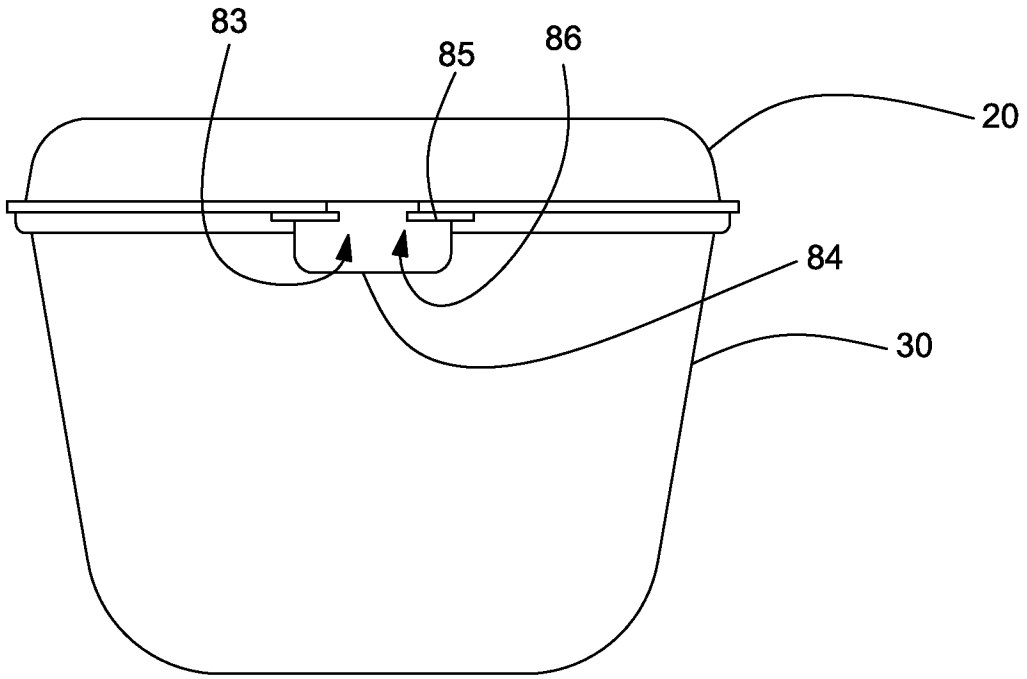
FIG. 3 is a front plan view of a thermally efficient container having a locking assembly for releaseably securing the lid to the base.

FIG. 3 is a front plan view of a thermally efficient container illustrating an example of a locking assembly 83 for releaseably securing the lid 20 to the base 30. In this example, the locking assembly 83 includes a flat first structure 84 that is coupled to a portion of the lid, and a second structure 85 that is coupled to a portion of the base 30. For example, the first structure 83 can be coupled to a portion of the outer lid 68, or in some embodiments, a portion of the inner lid 69. The second structure 85 can be coupled to a portion of the outer tub 64, or in some embodiments, a portion of the inner tub 66. The first structure 83 can be configured to be T-shaped such that a portion of the first structure 83 fits into notches 86 of the second structure 85. The notches 86 are also illustrated, for example, in FIG. 4.

Figure 4:
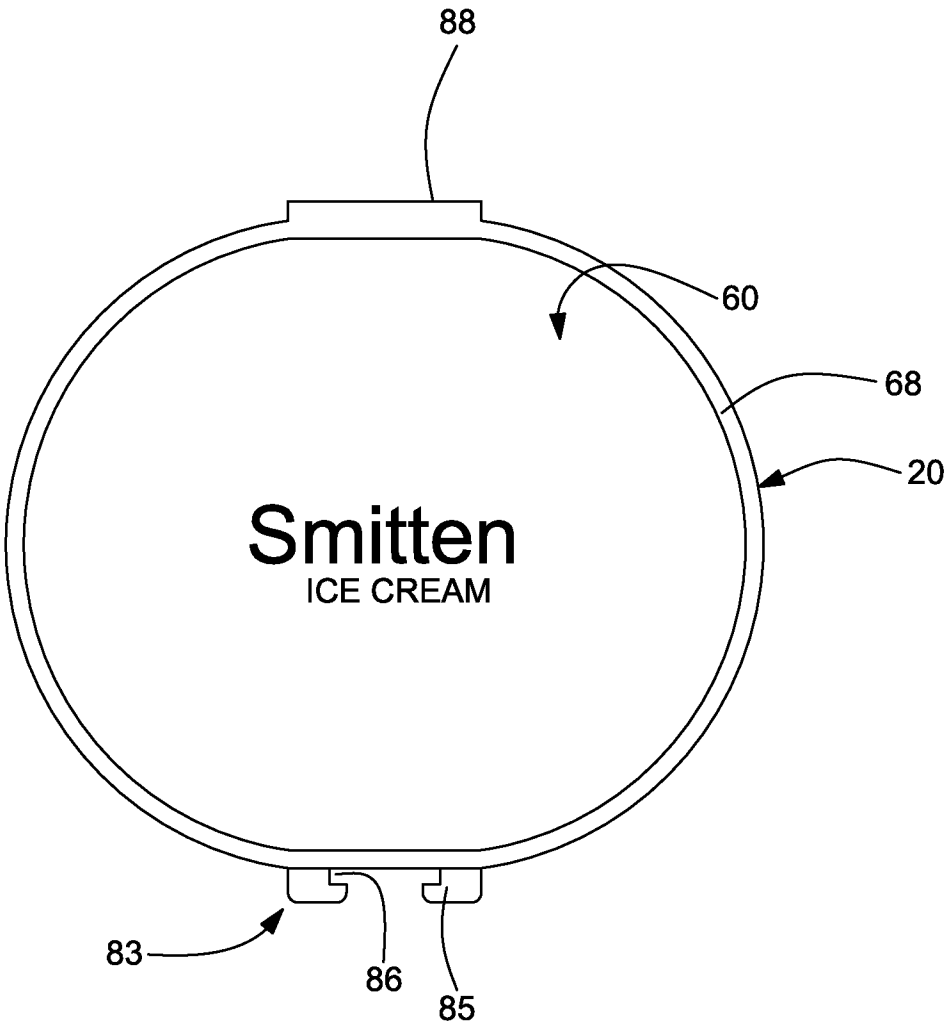
FIG. 4 is a top plan view of the container of FIG. 3, illustrating hinge and features of the locking assembly.

FIG. 4 is a top plan view of the container of FIG. 3, illustrating an embodiment that includes a hinge 88 that is coupled to the lid 20 and the base 30 (not shown in this view) of the container. This embodiment shows the container having one hinge 88, other embodiments may include two or more hinges 88. The hinge 88 can be coupled to a portion of the outer tub 64 and the outer lid 68, and configured to allow the lid 20 to open and close over the base 30. In some embodiments, the hinge 88 is formed from the same material as the portion of the lid 20 and the portion of the base 30 that the hinge 88 couples together, in such an embodiment may be referred to as a "living" hinge. FIG. 4 also further illustrates features of the locking assembly 83, including the second structure 85 in the notches 86 formed in the second structure 85.

Figure 5:
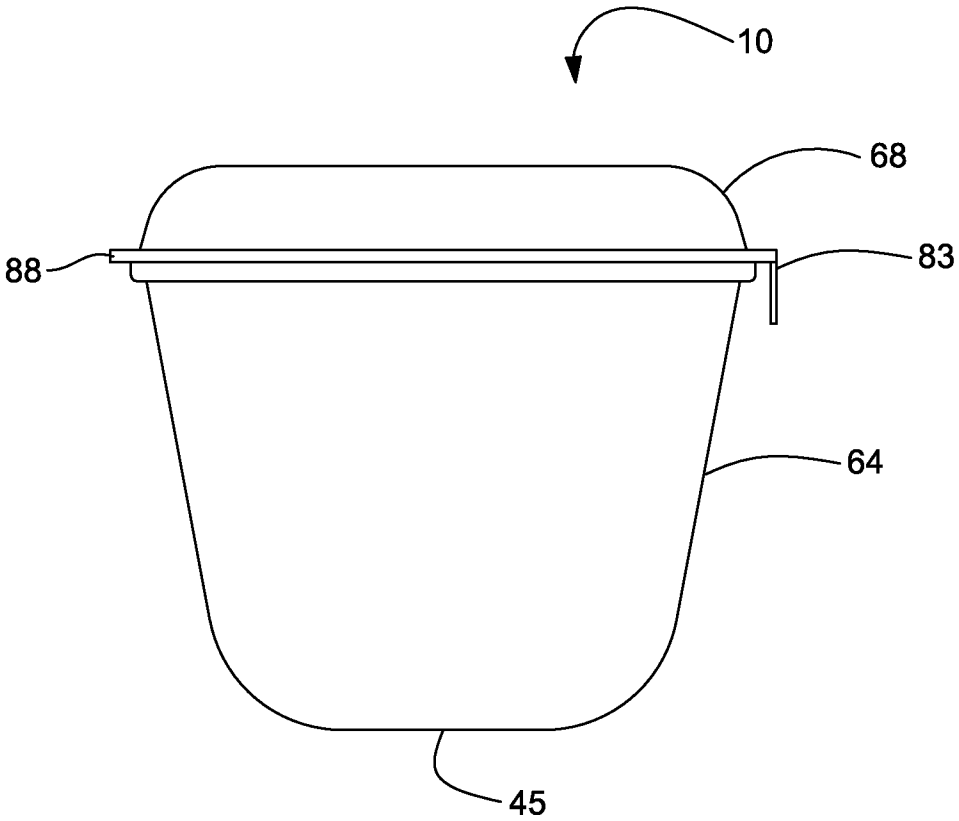
FIG. 5 is a side plan view of the container of FIG. 4.

FIG. 5 is a side plan view of the container 10 of FIG. 4, and illustrating the left side view of the container 10. In the embodiment shown in FIG. 5, the left side of the container 10 in the right side of the container 10 looks similar with the exception of the relative location of the hinge 88 and the locking assembly 83. In this view, the locking assembly 83 is shown positioned on the right portion of the container 10 (the front of the container 10) in the hinge 88 is shown on the left portion of the container 10 (the back of the container 10). Although not explicitly shown here, a right side view of the container 10 looks similar to the left side except, of course, the locking assembly 83 would be shown on the left portion of the container 10 and the hinge 88 would be shown on the right portion of the container 10, as can be seen for example in FIGS. 13 and 15.

Figure 6:
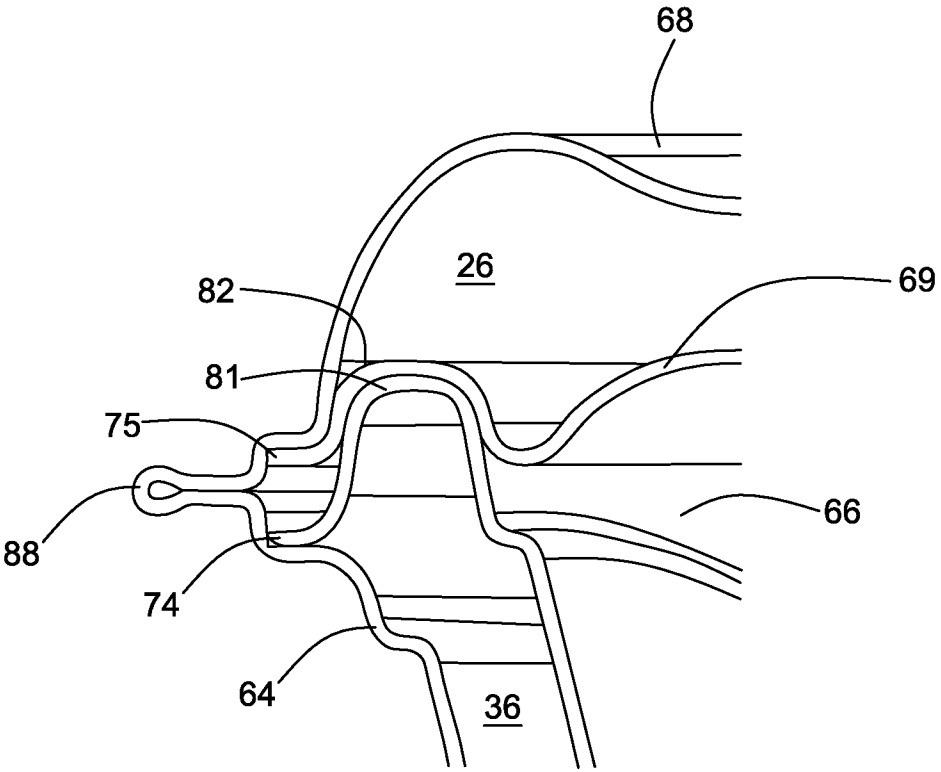
FIG. 6 is a cross sectional view illustrating a portion of an example of the outer lid, inner lid, inner tub, outer tub, and a hinge coupled to the outer lid and the outer tub.

FIG. 6 is a cross sectional view illustrating a portion of an example of the outer lid 68, inner lid 69, inner tub 66, outer tub 64, and a hinge 88 coupled to the outer lid 68 and the outer tub 64. In this example, the hinge 88 couples together the outer lid 68 and the outer tub 64. The hinge 88 is formed from the same material as the outer lid 68 and the outer tub 64, which makes manufacturing the outer container simpler and less costly. The first cavity 36 enclosed by a portion of the outer tub 64 and the inner tub 66. The second cavity 26 is enclosed by a portion of the inner lid 69 and the outer lid 68. A top portion 81 of the inner tub 66 is configured to fit into a support portion 82 of the inner lid when the lid is in a closed position. The edge 74 of the inner tub 66 fits against a portion of the outer tub 64 to lock the inner tub 66 into the outer tub 64. When the lid is in the closed position on the container, the force of the inner lid 69 pressing against the top portion 81 of the inner tub further helps to lock the inner tub 66 into the outer tub 64. In addition, the pressure of the support portion 82 of the lid pressing against the top portion 81 of the inner tub also helps to maintain a seal of the first cavity 36 formed between the outer tub 64 in the inner tub 66, such that air in the first cavity 36 provides insulative properties for the base of the container to keep a frozen (or hot) product in the base at the desired temperature. Likewise, the pressure of the top portion 81 of the inner tub lid support pressing against the support portion 82 of the inner lid helps to maintain a seal of the second cavity 26 formed between the inner led 69 in the outer lid 68, which helps the insulative properties of the lid of the container. The edge 75 of the inner lid pressing against a portion of the outer lid also helps to lock the inner lid 69 into the outer lid 68 and maintain second cavity to be sealed such that air in the second cavity 26 provide insulation to a frozen (or hot) product in the container.

FIG. 7A-7D illustrate configurations of four examples of configurations of rims and edges of the outer lid 68, inner lid 69, outer tub 64, and the inner tub 66 of a thermally efficient container that are different than the configuration of the thermally efficient container illustrated in FIG. 1A. In each of these configurations, a friction fit of a portion of the rims of the lids or the tubs and/or the pressure of an edge of the lids or the tubs pressing against a portion of a rim helps to seal the first cavity 36, the second cavity 26, and the lid 20 onto the base 30.

Figure 7A:
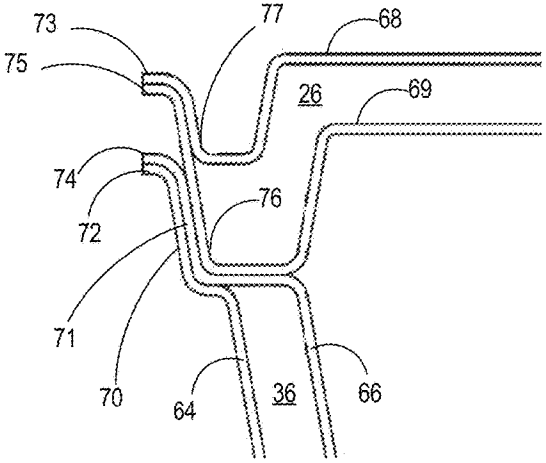
FIG. 7A-7D illustrate configurations of four examples of rims and edges of the outer lid, inner lid, outer tub, and the inner tub of a thermally efficient container that are different than the configuration of the thermally efficient container illustrated in FIG. 1A.

For example, in FIG. 7A a portion of the rim 77 of the outer lid 68 fits within a portion of the rim 76 of the inner lid 69 to help lock the inner lid 69 in the outer lid 68 together, at least partially through friction. A portion of the rim 71 of the inner tub 66 fits within a portion of the rim 70 of the outer tub 64 which helps to couple the inner tub 66 to the outer tub 64, at least partially through friction. In each of these embodiments 7A-7D, adjacent portions of the rims, when in contact with each other, couple the portions of the rim together at least partially through friction.

Figure 7B:
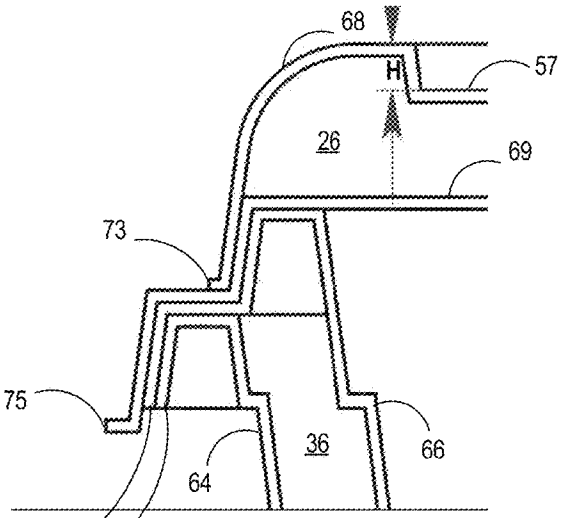

FIG. 7B shows an embodiment of the upper lid 68 that has a lowered portion 57 in the center of the lid (note: only a portion of the center of the symmetrical lid is shown in FIG. 7B), where the lowered portion is a distance H. In various embodiments, the distance H can be between 2 mm and 8 mm, for example, 4 mm. this lowered portion facilitates stacking the containers, where the base 45 of one container is placed on the outer lid 68 of another container. Any of the embodiments described herein may include a lowered center portion of the outer lid 68 is well. For example, FIG. 7D also has a lowered portion that slopes down from a raised edge 80 towards the center of the lid.

Figure 8A:
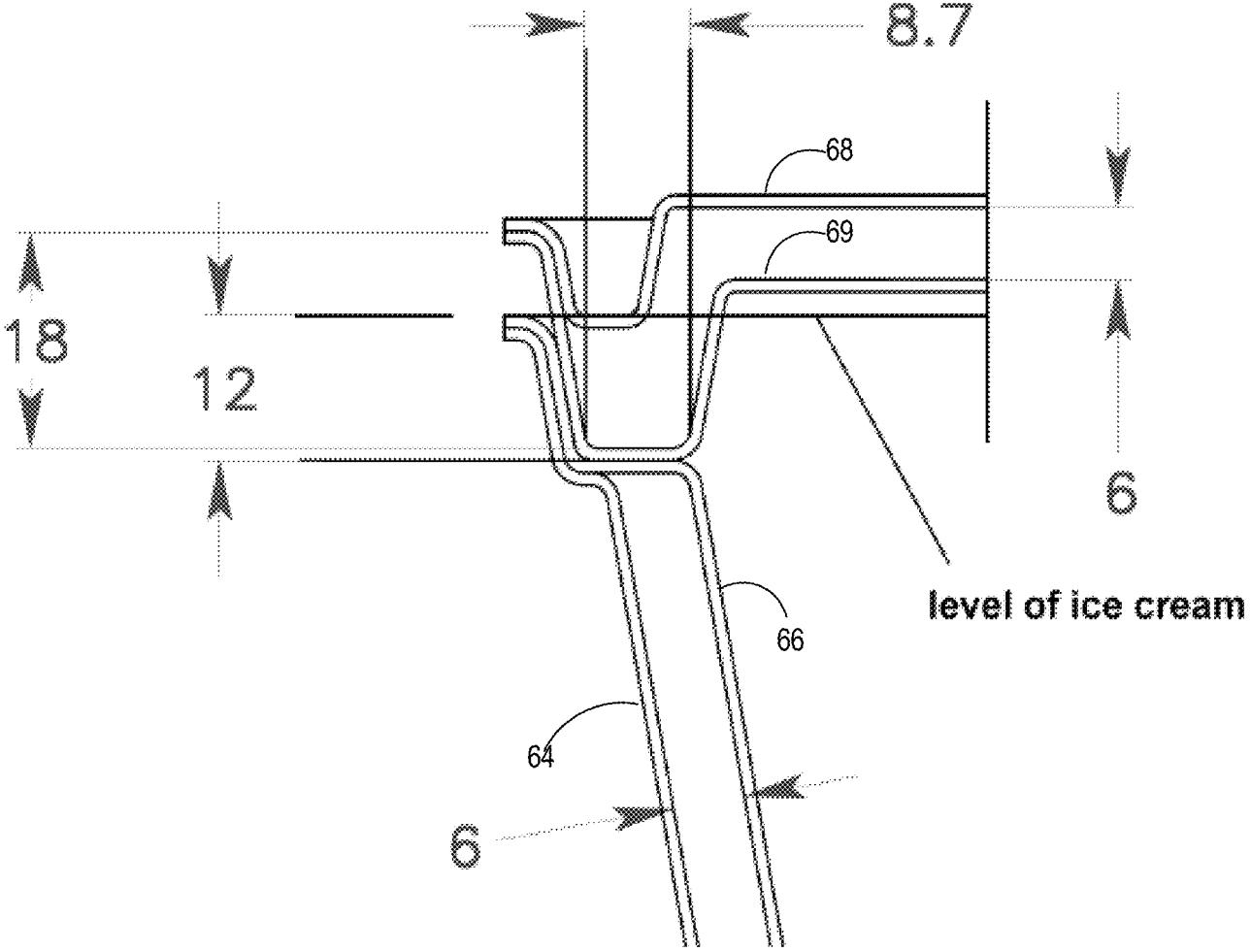
FIG. 8A illustrates certain details of the example of the thermally efficient container illustrated in FIG. 7A.

FIG. 8A illustrates certain details of the example of the thermally efficient container illustrated in FIG. 7A. FIG. 8A also provides some examples of dimensions of various portions of a container 10 in millimeters. FIG. 8A also shows an example of the position where a top level of a frozen product (ice cream) would be in a filled base 30. In this embodiment, the frozen product would be filled to the top edge of the inner tub. As discussed further in reference to FIG. 18, the top of the product can be at a certain location relative to the position of the inner lid 69 when the lid 20 is closed on the base 10 such that a raised portion 55 of the inner lid proximal surface in bosses and ornamental design 91 on the top of the frozen product such that the ornamental design 91 is visible when the lid 20 is opened.

Figure 8B:
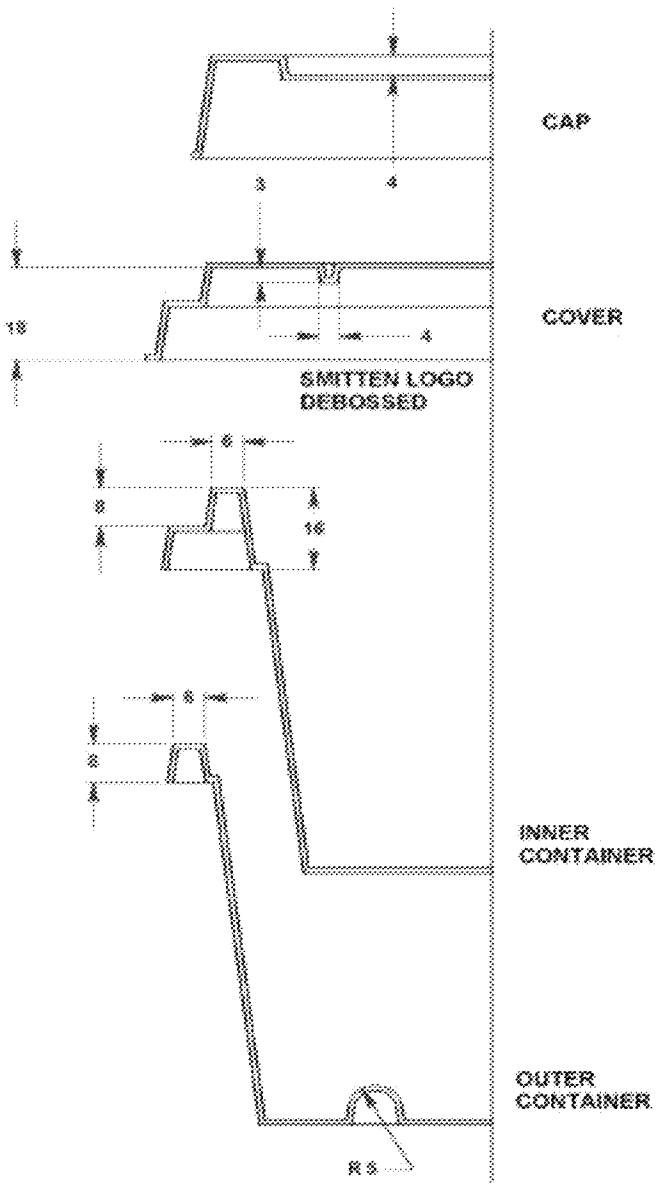
FIG. 8B illustrates certain details of the example of the thermally efficient container illustrated in FIG. 7B.
Figure 8B:
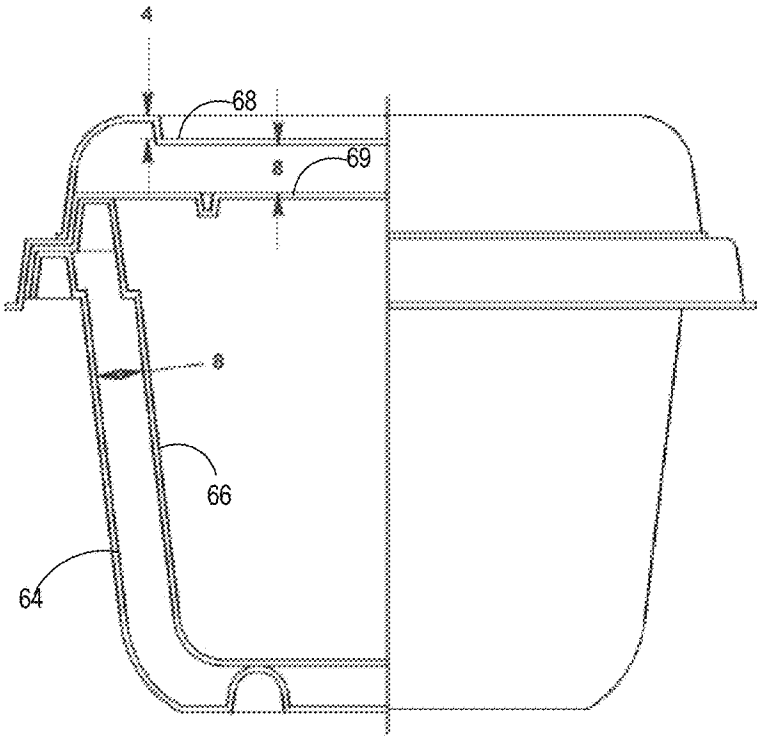

FIG. 8B illustrates certain structural details of the example of the thermally efficient container illustrated in FIG. 7B. FIG. 8B also shows certain example dimensions of the embodiment, indicated in millimeters. FIG. 8B also shows a breakout of a cap portion (outer lid 68), a cover (inner lid 69) in inner container (inner tub 66) in an outer container (outer tub 64).

Figure 7C:
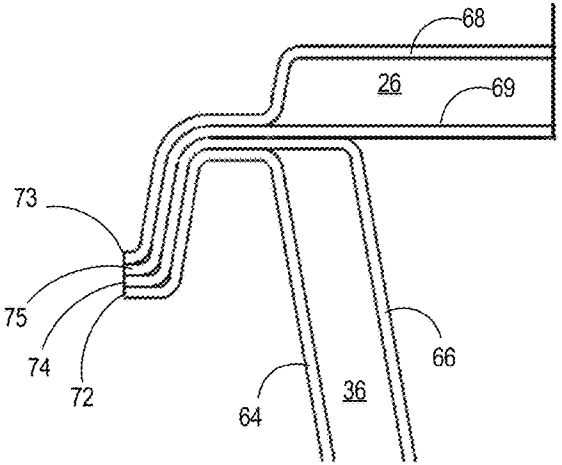
Figure 7D:
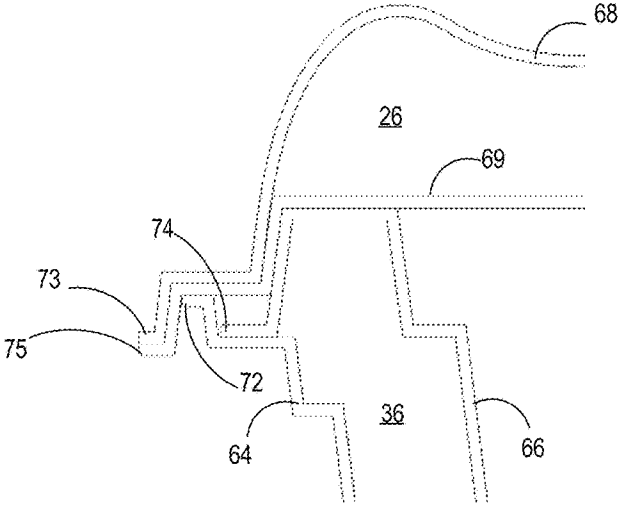
Figure 8C:
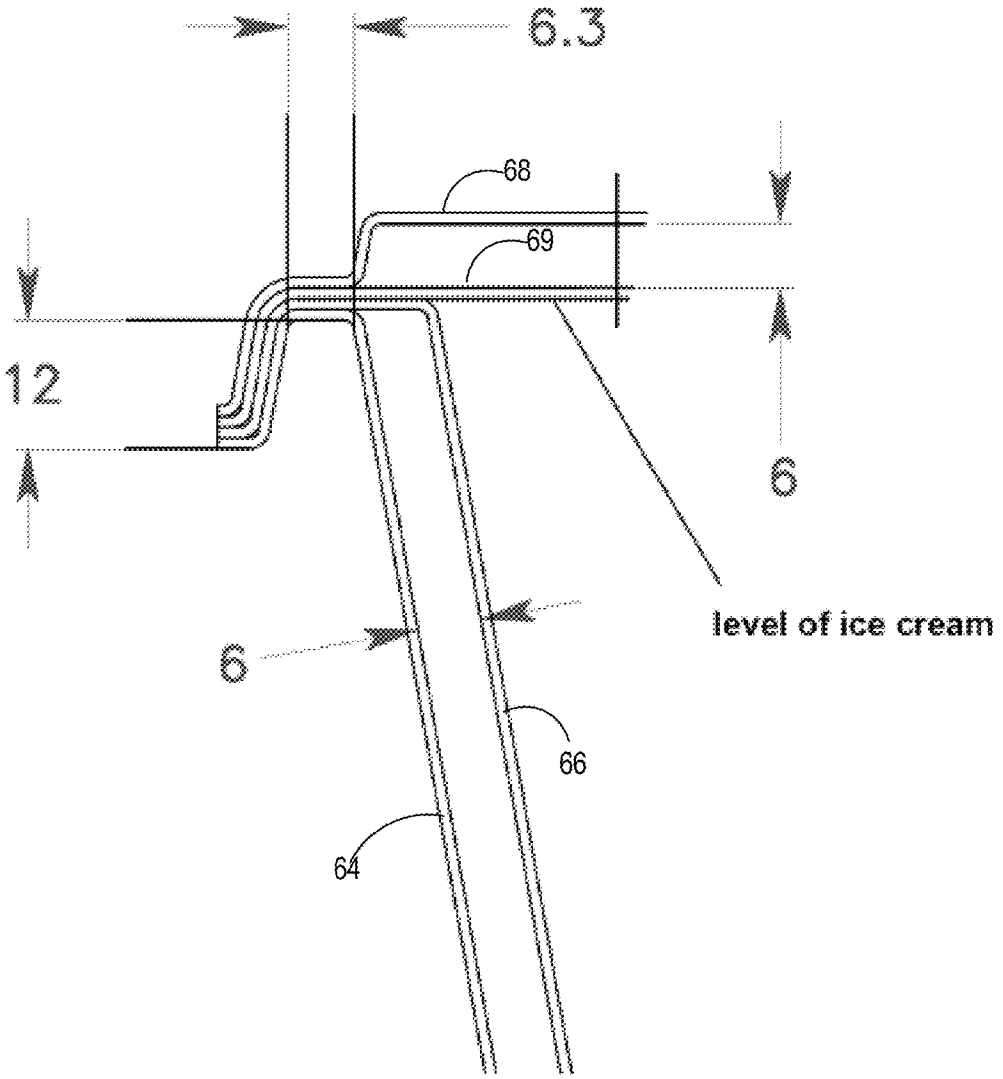
FIG. 8C illustrates certain details of the example of the thermally efficient container illustrated in FIG. 7C.

FIG. 8C illustrates certain details of the example of the thermally efficient container illustrated in FIG. 7C. FIG. 8B also shows certain example dimensions of the embodiment, indicated in millimeters.

Figure 9:
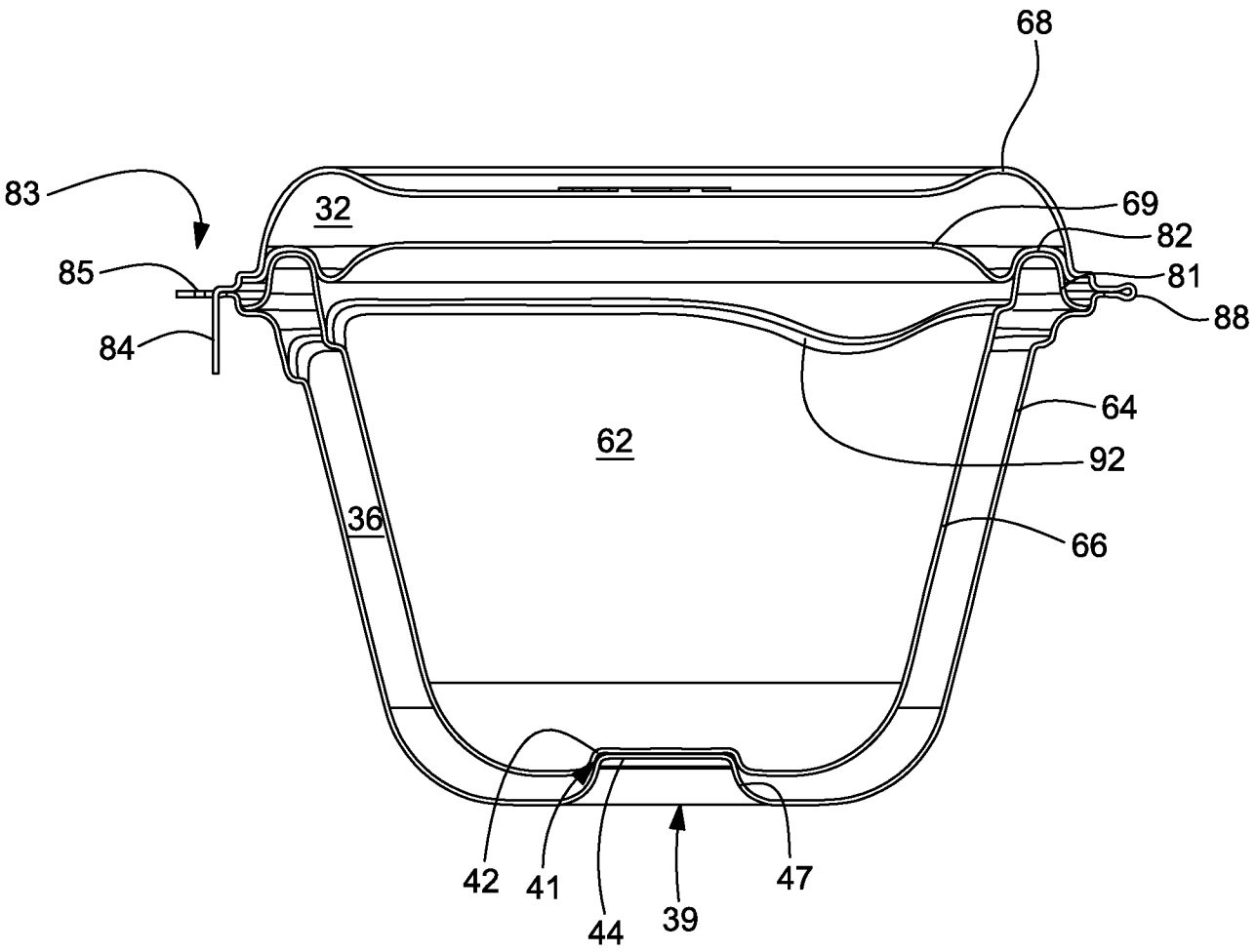
FIG. 9 illustrates is a cross section view of an example of a thermally efficient container through a portion of the hinge and the locking assembly.
Figure 14:
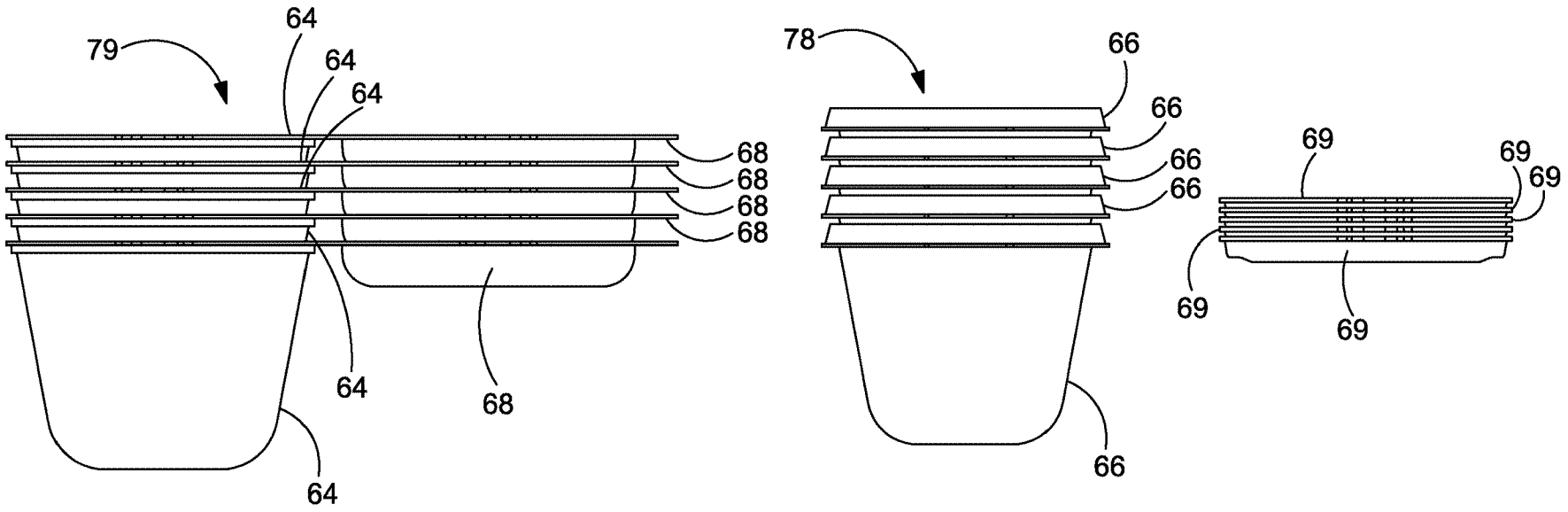
FIG. 14 illustrates an example of a plurality of outside containers that are nested together where the outer tubs are nested together and the outer lids are nested together in a compact fashion that is advantageous for shipping and storage of the outside containers.

FIG. 9 illustrates is a cross sectional view of an example of a thermally efficient container, the cross section extending through a portion of the hinge 88 and the locking assembly 83. In this view, the first structure 84 of the locking assembly can be seen extending through the second structure 85 of the locking assembly 83 to secure the outer lid 68 to the outer tub 64. The embodiment illustrated in FIG. 9 also includes a separation feature 92 on the inner tub 66, which can be included in various embodiments as an optional feature. The separation feature 92 is configured to help separate a plurality of inner tubs 66 that are nested together, for example, as illustrated in FIG. 14. In some embodiments, the separation feature 92 protrudes from the proximal surface 52 or the distal surface 50 of the inner tub 66. The separation features can be formed from the proximal surface 52 or the distal surface 50. When the inner tubs 66 are nested together, the separation feature 92 can lower the frictional coupling force between the touching surfaces of the nested inner tubs by lowering the surface area where they are in contact, and as a handling point to grasp to help separate nested inner tubs 66.

Figure 10:
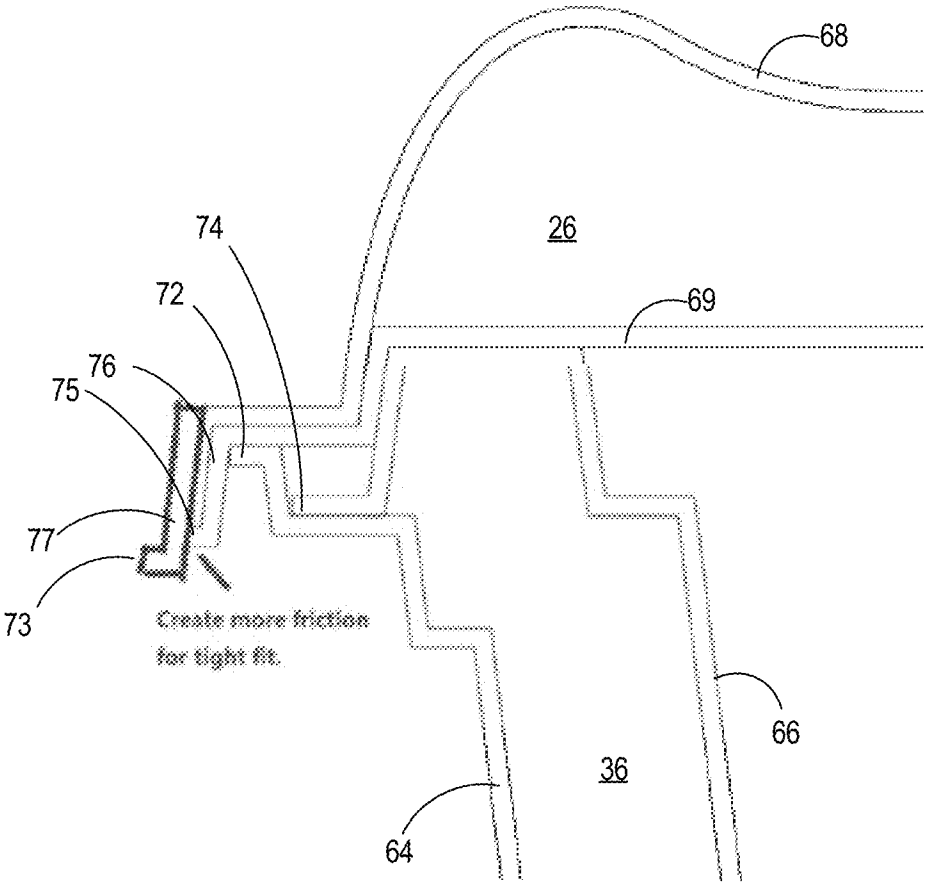
FIG. 10 illustrates a cross sectional view of another example of a configuration of a lid-to-container interface of a thermally efficient container.

FIG. 10 illustrates a cross sectional view of another example of a configuration of a lid-to-container interface of a thermally efficient container. In this embodiment, the edge 73 of the outer lid 68 extends over the edge 75 of the inner lid 69, such that the edge 75 of the inner lid pushes against a portion of the rim 77 of the outer lid 68 and a portion of the rim 77 of the outer lid 68 contacts a portion of the rim 76 of the inner lid 69, to create more friction for a tighter fit.

Figure 11:
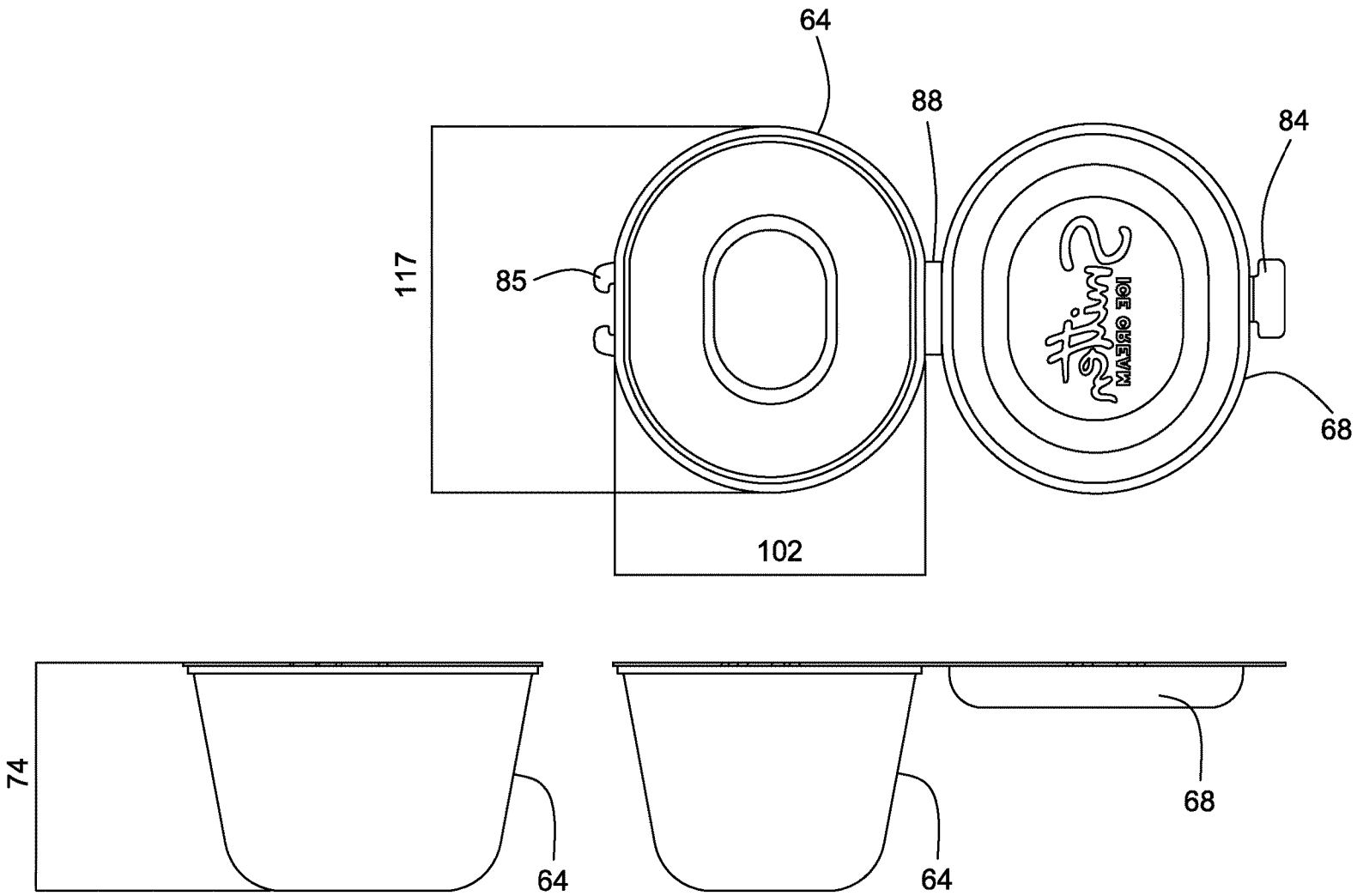
FIG. 11 illustrates an example of an outer tub coupled to an outer lid.

FIG. 11 illustrates an example of an outer container including an outer tub 64 coupled to an outer lid, showing a top view of the outer container, a front view and a side view. FIG. 11 also illustrates some example dimensions for the outer tub 64. In this example, as illustrated in the front view the height of the outer tub can be 74 mm. In this example, as illustrated in the top view the length of the tub can be 117 mm. In this example, as illustrated in the top view the width of the tub can be 102 mm. In other examples the dimensions may vary in order for the container to hold more product or less product.

Figure 12:
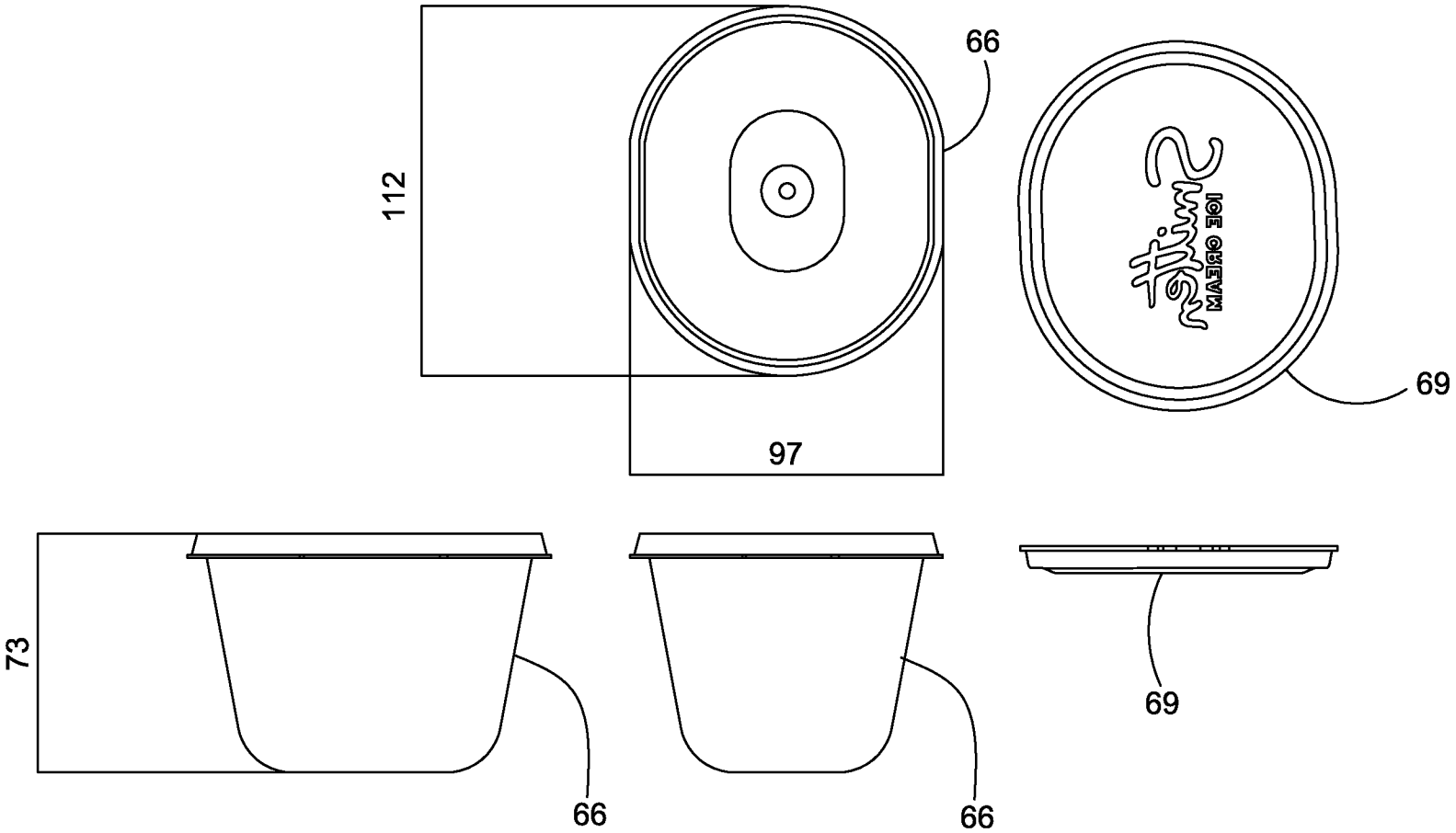
FIG. 12 illustrates an example of an inner tub and an inner lid.

FIG. 12 illustrates an example of an inner container including an inner tub 66 and an inner lid 69. The inner tub 66 is not coupled to the inner lid 69. However, in some embodiments the inner lid 69 may be coupled to the inner tub 66. FIG. 12 also illustrates some example dimensions for the inner tub 66. In this example, as illustrated in the top view the length of the inner tub 66 is 112 mm. in this example, as illustrated in the top view the width of the inner tub 66 can be 97 mm. In this example as illustrated in the front view the height of the inner tub 66 can be 73. In other examples the dimensions may vary in order for the container to hold more product or less product.

Figure 13:
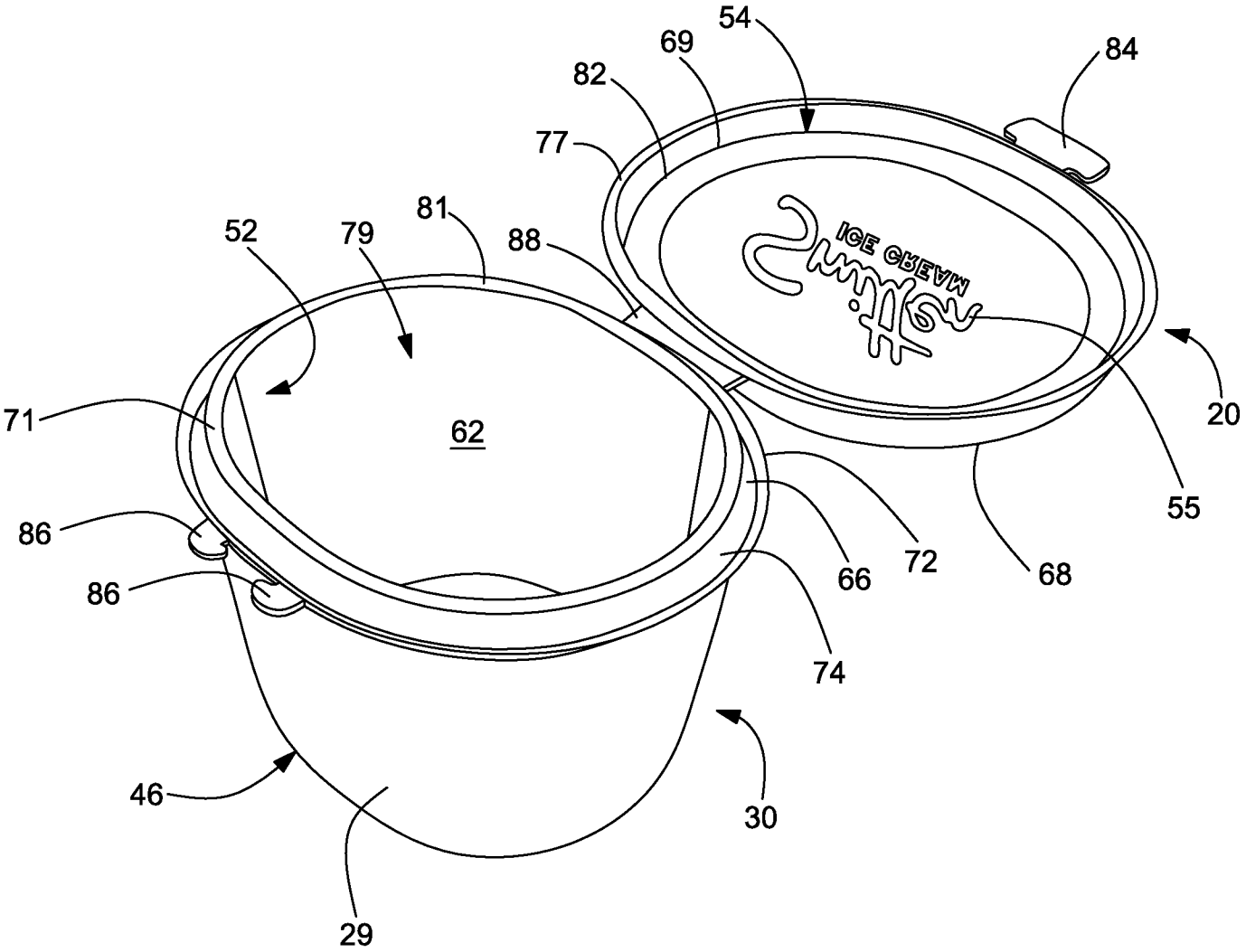
FIG. 13 illustrates an example of a thermally efficient container, where the inner tub is positioned in the outer tub and the inner lid is positioned in the outer lid.

FIG. 13 illustrates an example of a thermally efficient container, where the inner tub 66 is positioned in the outer tub 64 and the inner lid 69 is positioned in the outer lid 68. Thus, FIG. 13 illustrates an inner container (that includes the inner tub 66 and the inner lid 69) positioned in an outer container (that includes the outer tub 64 in the outer lid 68). FIG. 13 also illustrates the second chamber 62 of the inner tub 66 which is configured to receive a frozen or a hot product. Further illustrates a raised portion 55 of the inner lid 69. The raised portion 55 extends away from the inner lid proximal surface 54. The raised portion 55 can be designed to depict and ornamental design. For example, one or more words or symbols, or a logo. The raised portion 55 can be used to emboss a top surface of a frozen product that is filled into the second chamber 62 when the lid 20 is closed onto the container 30.

FIG. 14 illustrates an example of a plurality of outside containers that are nested together where the outer tubs 64 are nested together and the outer lids 68 are nested together in a compact fashion that is advantageous for shipping and storage of the outside containers. FIG. 14 also illustrates a plurality of inside containers with the inner tubs 66 are nested together and the inner lids 69 are nested together in a compact fashion that is advantageous for shipping and storage of the inside containers.

Figure 15:
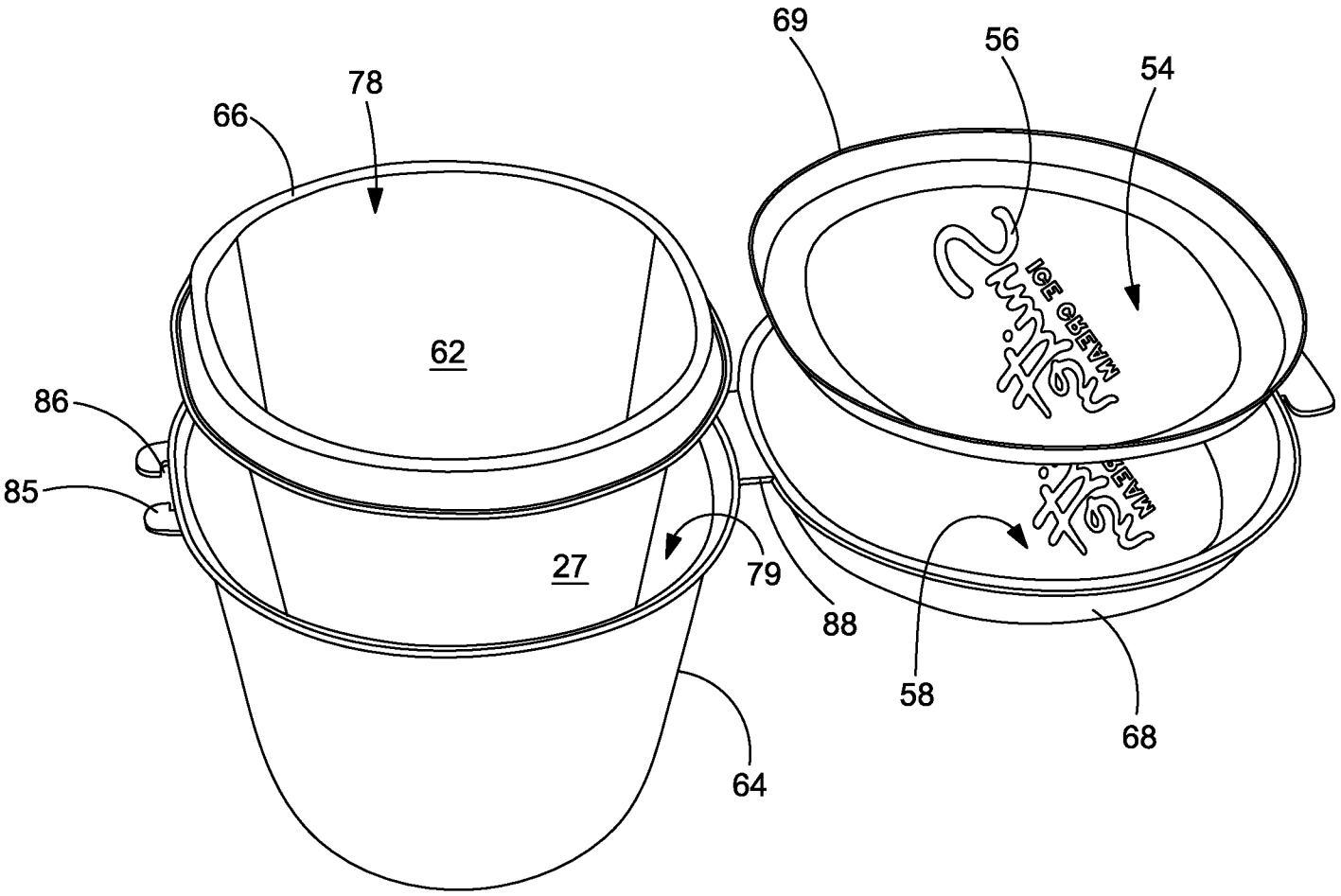
FIG. 15 illustrates an example of a thermally efficient container where the inner tub of the inner container is positioned partially within the outer tub of the outer container, and the inner lid of the inner container is positioned above the outer lid of the outer container, demonstrating how the inner container in the outer container can be assembled to form the thermally efficient container.

FIG. 15 illustrates an example of a thermally efficient container where the inner tub 66 of the inner container is positioned partially within the outer tub 64 of the outer container, and the inner lid 69 of the inner container is positioned above the outer lid 68 of the outer container, demonstrating how the inner container in the outer container can be assembled to form the thermally efficient container. FIG. 15 also shows the outer tub 64 having an opening 79 in the top portion of the outer tub 64. Also shows the inner tub 66 heaven and an opening 78 at the top portion of the inner tub 66. The first cavity 36 (shown in FIG. 1A) is formed between the inner tub 66 and the outer tub 64 when the inner tub 66 is positioned inside of the outer tub 64. The first cavity 36 is completely enclosed when one or more edges or rims of the inner tub 66 are coupled to one or more rims or edges of the outer tub 64, for example, by friction or pressure. The second cavity 26 (shown in FIG. 1A) is formed between the inner lid 69 in the outer lid 68 when the inner lid 69 is positioned inside of the outer lid 68. The second cavity 26 is completely enclosed when one or more edges or rims of the inner lid 69 a couple to one or more rims or edges of the outer lid 68, for example, by friction or pressure. Although in some embodiments, an adhesive can be used too couple the inner lid 69 to the outer lid 68 and/or too couple the inner tub 66 to the outer tub 64, in the illustrated embodiments herein the inner lid 69 is coupled to the outer lid 68 without an adhesive, that is, through friction and/or pressure. Similarly, the inner tub 66 is coupled to the outer tub 64 without an adhesive, that is, through friction and/or pressure.

Figure 16:
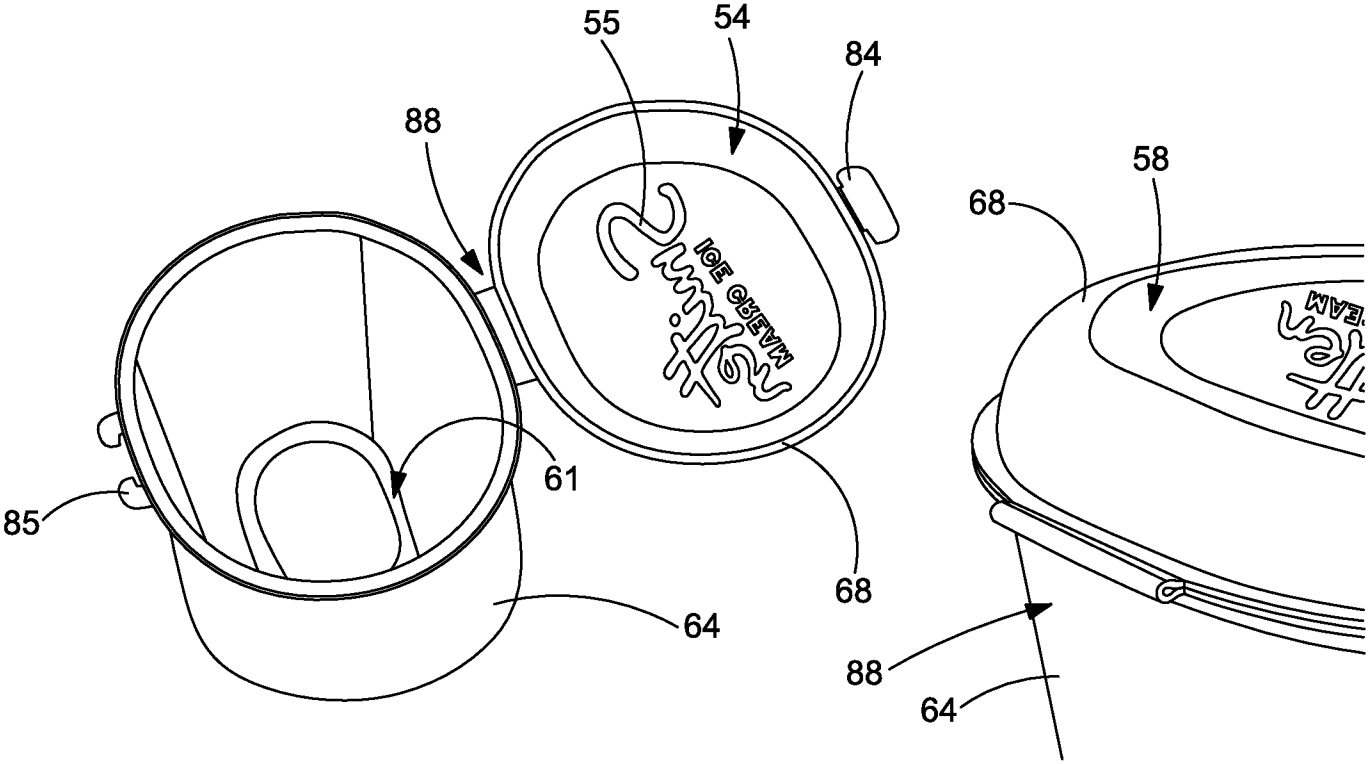
FIG. 16 illustrates various features of an example of an outer container of a thermally efficient container.

FIG. 16 illustrates a further view of the outer container showing various features of an example of an outer container of a thermally efficient container. For example, showing the second structure 85 of the locking assembly, the hinge 88 which couples together the outer lid 68 and the outer tub 64, and the first structure 84 of the locking assembly. FIG. 16 also illustrates the outer tub 64 without the inner tub positioned inside of the outer tub, thus exposing the first chamber 61 of the outer tub 64.

Figure 17:
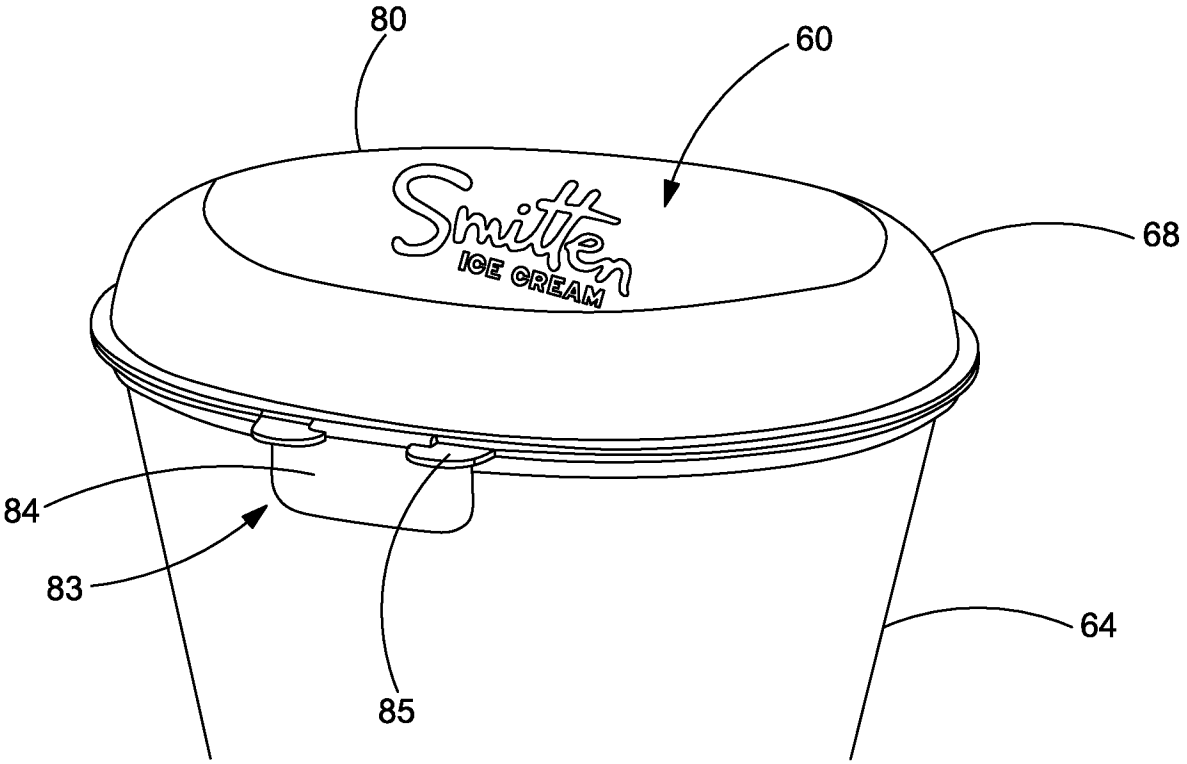
FIG. 17 illustrates various features of an example of an outer container of the thermally efficient container, including various features of the locking assembly.

FIG. 17 illustrates another view of an example of an outer container of the thermally efficient container, including various features of the locking assembly 83. Here, the first structure 84 of the locking assembly 83 can be seen extending through the notches of the second structure 85 of the locking assembly 83.

Figure 18:
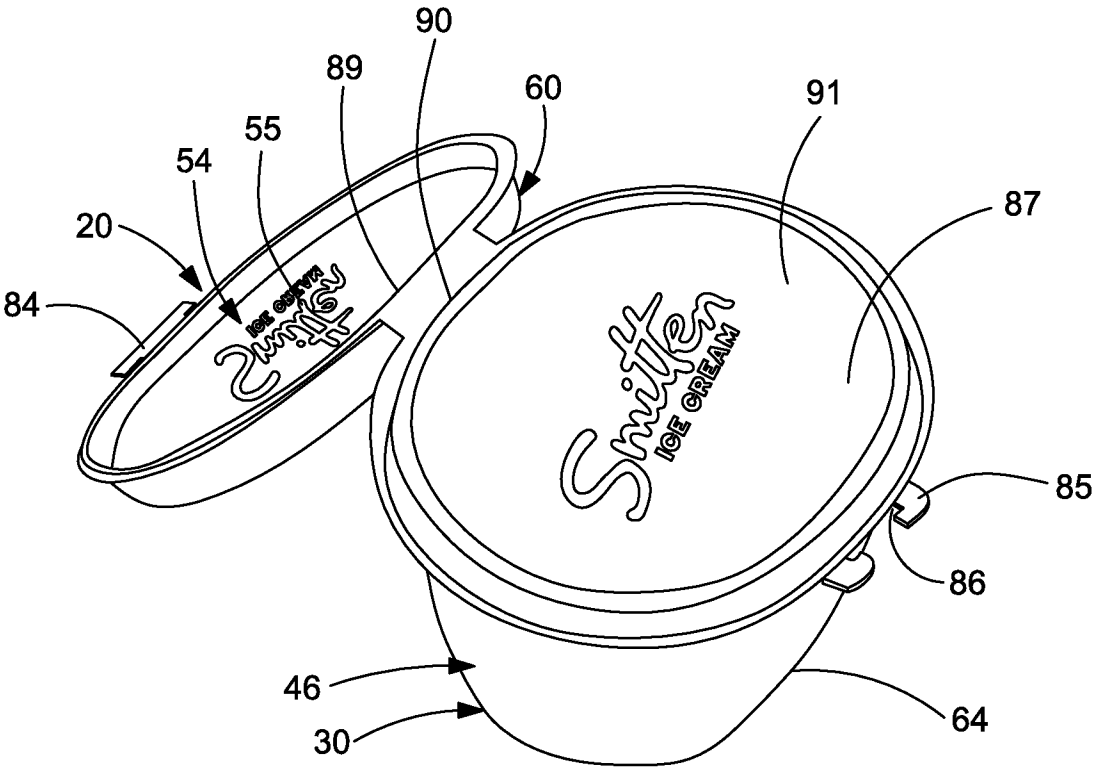
FIG. 18 illustrates various features of an example of a thermally efficient container that contains a product, and showing for example how a raised surface on the proximal surface of the inner lid configured as an ornamental design makes an embossed ornamental design on the product when the lid of the thermally efficient container is closed.

FIG. 18 illustrates an example of a thermally efficient container that contains a product. FIG. 18 also shows an example of a raised surface 55 on the inner lid proximal surface 54 is configured as an ornamental design. When the lid 20 is closed onto the base 30, the raised surface 55 presses against the product 87 filling the base 30 such that the raised surface 55 embosses the ornamental design 91 onto the product 87, and the embossed ornamental design 91 is visible on the top surface of the product 87 when the lid 20 is opened.

In the foregoing description, specific details are given to provide a thorough understanding of the examples. However, it will be understood by one of ordinary skill in the art that the examples may be practiced without these specific details. Certain features that are described separately herein can be combined in a single embodiment, and the features described with reference to a given embodiment also can be implemented in multiple embodiments separately or in any suitable subcombination.

The term "substantially" when used in conjunction with the term "real-time" forms a phrase that will be readily understood by a person of ordinary skill in the art. For example, it is readily understood that such language will include speeds in which no or little delay or waiting is discernible, or where such delay is sufficiently short so as not to be disruptive, irritating, or otherwise vexing to a user.

Conjunctive language such as the phrase "at least one of X, Y, and Z," or "at least one of X, Y, or Z," unless specifically stated otherwise, is to be understood with the context as used in general to convey that an item, term, etc. may be either X, Y, or Z, or a combination thereof. For example, the term "or" is used in its inclusive sense (and not in its exclusive sense) so that when used, for example, to connect a list of elements, the term "or" means one, some, or all of the elements in the list. Thus, such conjunctive language is not generally intended to imply that certain embodiments require at least one of X, at least one of Y, and at least one of Z to each be present.

The term "a" as used herein should be given an inclusive rather than exclusive interpretation. For example, unless specifically noted, the term "a" should not be understood to mean "exactly one" or "one and only one"; instead, the term "a" means "one or more" or "at least one," whether used in the claims or elsewhere in the specification and regardless of uses of quantifiers such as "at least one," "one or more," or "a plurality" elsewhere in the claims or specification.

The term "comprising" as used herein should be given an inclusive rather than exclusive interpretation. For example, a thermally efficient container comprising one or more structures should not be interpreted as excluding other structures, and may possibly include such components as a one or more hinges, locking assemblies, surfaces, support structures, configurations of edges of tubs and lids, among others.

While the above detailed description has shown, described, and pointed out novel features as applied to various embodiments, it may be understood that various omissions, substitutions, and changes in the form and details of the devices or processes illustrated may be made without departing from the spirit of the disclosure. As may be recognized, certain embodiments of the inventions described herein may be embodied within a form that does not provide all of the features and benefits set forth herein, as some features may be used or practiced separately from others. The scope of certain inventions disclosed herein is indicated by the appended claims rather than by the foregoing description. All changes which come within the meaning and range of equivalency of the claims are to be embraced within their scope.

The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. A thermally efficient container system, comprising:

a plurality of outer containers, each outer container including an outer tub having a first base and a first sidewall, the first sidewall extending from the first base to a rim that surrounds a top opening of the outer tub, the first base and first sidewall together defining a first chamber at least partially surrounded by the outer tub, the outer tub having a proximal surface adjacent to the first chamber and a distal surface opposite the proximal surface, and an outer lid coupled to the outer tub via a hinge, the lid configured to fit over the top opening of the outer tub and move, via the hinge, from an open position not covering the top opening to a closed position covering the top opening, the outer lid having an proximal surface configured to face towards the first chamber of the outer tub when the outer lid is closed over the top opening of the outer tub, and a distal surface opposite the proximal surface; and a plurality of inner containers, each inner container including an inner tub having a second base and a second sidewall that extends from the second base to a rim that surrounds a top opening of the inner tub, the second base and second sidewall together defining a second chamber at least partially surrounded by the inner tub, the inner tub having a proximal surface adjacent to the second chamber and a distal surface opposite the proximal surface, the inner tub configured to fit in the first chamber of the outer tub at a position to form a first cavity between the proximal surface of the outer tub and the distal surface of the inner tub, the inner tub and the outer tub configured to contact each other along at least a portion of the rim of the outer tub and a portion of the rim of the inner tub when the inner tub is positioned in the first chamber, and an inner lid configured to fit within at least a portion of the outer lid and adjacent to the proximal surface of the outer lid forming an enclosed second cavity between the inner lid and the outer lid, the inner lid having a proximal surface configured to face towards the second chamber of the inner tub when the inner lid is positioned in the outer lid and the outer lid is closed over the top opening of the outer tub, the inner lid further having a distal surface opposite the proximal surface facing the outer lid when the inner lid is positioned in the outer lid, wherein the plurality of outer containers are configured to fit together in a nested fashion such that an outer tub of a first outer container fits into at least a portion of the first chamber of an adjacently disposed outer tub of a second outer container, and the outer lid of the first outer container fits into at least a portion of an outer lid of the second outer container, and wherein the plurality of inner containers are configured to fit together in a nested fashion such that an inner tub of a first inner container fits into at least a portion of the second chamber of an adjacently disposed inner tub of a second inner container, and the inner lid of the first inner container fits into at least a portion of the inner lid of the second inner container.

2. The thermally efficient container system of claim 1, wherein the hinge is coupled to an edge of the outer lid and the rim of the outer tub, the hinge comprising the same material as the outer tub and the outer lid.

3. The thermally efficient container system of claim 1, wherein the proximal surface of each inner lid includes a partially raised portion having an ornamental design, the partially raised portion configured to extend partially into the second chamber when the inner lid is in a closed position over the second chamber such that the partially raised inner portion of the proximal surface of the inner lid can contact a top surface of a product filling the inner tub.

4. The thermally efficient container system of claim 1, wherein the size of a gap of the first cavity is between about 3 mm and about 7 mm, and at least a portion of a gap of the second is between about 3 mm and about 7 mm.

5. The thermally efficient container system of claim 1, wherein the first cavity is formed between at least 90% of the area of the proximal surface of the outer tub and the distal surface of the inner tub.

6. The thermally efficient container system of claim 1, wherein the first base of each outer container includes at least one support extending towards the first chamber, the at least one support configured to contact the distal surface of the inner container.

7. The thermally efficient container system of claim 6, wherein the at least one support is configured to contact less than 10% of the distal surface of the inner container.

8. The thermally efficient container system of claim 7, wherein the at least one support is configured to contact less than 5% of the distal surface of the inner container.

9. The thermally efficient container system of claim 8, wherein the at least one support is configured to contact less than 2% of the distal surface of the inner container.

10. The thermally efficient container system of claim 6, wherein the at least one support comprises a raised portion of the base of the outer container, the raised portion extending towards the first chamber.

11. The thermally efficient container system of claim 6, wherein the at least one support comprises two or more supports.

12. The container system of claim 6, wherein the second base of the inner container includes at least one recess, the at least one recess located on the second base at a location corresponding to the location of the at least one support of the outer container, and the at least one recess configured to receive at least a portion of a corresponding at least one support.

13. The container system of claim 1, wherein each outer container further comprises a locking assembly.

14. The container system of claim 13, wherein the locking assembly comprises a first structure coupled to an edge of the outer lid, and a second structure of the locking assembly coupled to an edge of the outer tub.

15. The container system of claim 14, wherein the first structure is flat and t-shaped, and wherein the second structure includes at least one notch, the locking assembly configured to have a portion of the first structure extend through the at least one notch when the locking mechanism is in a locked position.

* * * * *